US008707915B2

(12) United States Patent
Inaba et al.

(10) Patent No.: US 8,707,915 B2
(45) Date of Patent: Apr. 29, 2014

(54) OUTBOARD ENGINE UNIT

(75) Inventors: Takeshi Inaba, Wako (JP); Kazuhiro Ishizaka, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 13/529,465

(22) Filed: Jun. 21, 2012

(65) Prior Publication Data

US 2013/0019820 A1 Jan. 24, 2013

(30) Foreign Application Priority Data

Jul. 23, 2011 (JP) ..... 2011-161453

(51) Int. Cl.
*F01P 3/22* (2006.01)

(52) U.S. Cl.
USPC ..... 123/41.54; 123/41.48; 123/41.63; 123/41.65; 123/41.66; 123/198 E; 415/116; 440/37; 440/77; 440/88 A; 440/88 C; 440/88 R

(58) Field of Classification Search
USPC ..... 123/41.54, 41.48, 41.63, 41.65, 41.66, 123/198 E, 195 C, 195 P; 415/116; 440/37, 440/77, 88 A, 88 C, 88 R, 89 R, 76, 89 E, 440/89 G, 89 J; 114/211
See application file for complete search history.

(56) References Cited

U.S. PATENT DOCUMENTS

2010/0147234 A1* 6/2010 Sakata et al. ..... 123/41.7

FOREIGN PATENT DOCUMENTS

JP 3608637 B2 1/2005

* cited by examiner

*Primary Examiner* — Lindsay Low
*Assistant Examiner* — Ruben Picon-Feliciano
(74) *Attorney, Agent, or Firm* — Westerman, Hattori, Daniels & Adrian, LLP

(57) ABSTRACT

An exhaust fan chamber is defined with a belt cover and a fan cover provided over the belt cover, and an exhaust fan is accommodated in the exhaust fan chamber. The fan cover has an air intake port for sucking air within an engine cover into the exhaust fan chamber and an exhaust outlet port for discharging air within the exhaust fan chamber to outside of the exhaust fan chamber. The exhaust outlet port is in communication with an exhaust opening formed in an upper portion of the engine cover so that the air discharged through the exhaust outlet port is discharged to outside of the engine cover through the exhaust opening.

3 Claims, 24 Drawing Sheets

25
24a
24
71
83
87
71b
81
85
84
71a
24c
82
72
104
106
58
65
56
65a
57
65b
66
55
55a
42
54
49
48
43
27a
23
27

35
10
24
26
71
95
81
93
87
93a
92b
87b
81a
91
92
92a
81c
83
93b
85
84
82
81b
12
11a

OUTBOARD ENGINE UNIT

FIELD OF THE INVENTION

The present invention relates to outboard engine units which include an engine provided within an engine cover and which is constructed to discharge air from within the engine cover to outside of the engine cover.

BACKGROUND OF THE INVENTION

Heretofore, outboard engine units have been known which include an exhaust means (exhaust duct) provided in an engine cover that covers an upper section of an engine, and in which an inlet port of the exhaust duct opens to an engine room and an outlet port of the exhaust duct opens into an exhaust chamber.

One example of such outboard engine units is disclosed in Japanese Patent No. 3,608,637 (hereinafter referred to as "the relevant patent literature"). In the outboard engine unit disclosed in the relevant patent literature, air heated in the engine flows from the engine room into the exhaust duct via the duct's inlet port and then into the exhaust chamber via the duct's outlet port. With the outboard engine unit attached to a hull or body of a watercraft, an exhaust outlet port of the exhaust chamber is located rearwardly of the watercraft body. Thus, when the watercraft body is slidingly travel along the water surface, a negative pressure is produced in an area outside the exhaust outlet port, so that the air having flown into the exhaust chamber is discharged via the exhaust outlet port. By discharging the air within the engine room (i.e., from within the engine room) via the exhaust outlet port as noted above, the engine room can be cooled, and thus, the engine can constantly achieve appropriate performance.

Namely, the exhaust duct disclosed in the relevant patent literature is constructed to discharge, via the exhaust outlet port, the air from within the engine room (engine cover) utilizing the negative pressure produced outside the exhaust outlet port during sliding travel of the watercraft. In order to keep the engine performance even more appropriate, there is a need to discharge the air from within the engine cover in a more stable manner. As a means for meeting the need, there has been known an exhaust means where an exhaust fan is provided at a halfway or en route position in the exhaust duct. By rotation of the exhaust fan provided at en route position in the exhaust duct, the air within the engine cover can be compulsorily discharged through the exhaust outlet port. However, in order to discharge the air from within the engine cover more efficiently, there is a further need to improve an outer peripheral shape of the exhaust fan and a shape of an exhaust passageway.

SUMMARY OF THE INVENTION

In view of the foregoing prior art problems, it is an object of the present invention to provide an improved outboard engine unit which can efficiently discharge air from within the engine cover.

In order to accomplish the above-mentioned object, the present invention provides an improved outboard engine unit, which comprises: an engine cover covering an engine, a drive belt for driving engine accessories being provided within the engine cover; a belt cover covering an upper portion of the drive belt; and an exhaust fan chamber defined with the belt cover and a fan cover provided over the belt cover, the exhaust fan chamber being partitioned off from a remaining interior space of the engine cover, an exhaust fan being accommodated in the exhaust fan chamber, the fan cover having an air intake port for sucking air within the engine cover into the exhaust fan chamber and an exhaust outlet port for discharging air within the exhaust fan chamber to outside of the exhaust fan chamber, the exhaust outlet port being in communication with an exhaust opening formed in an upper portion of the engine cover so that the air discharged out of the exhaust fan chamber through the exhaust outlet port is discharged to outside of the engine cover through the exhaust opening.

In the present invention, the exhaust fan chamber is defined with the belt cover and the fan cover provided over the belt cover. Because the belt cover and the fan cover are provided over the engine independently of the engine. Thus, the belt cover and the fan cover can be formed in any desired shapes without being influenced by the outer shape of the engine. Because any desired shapes can be chosen for the belt cover and the fan cover like this, undesired gaps and uneven concave-convex portions can be removed from the exhaust fan chamber. By undesired gaps and uneven concave-convex portions being removed from the exhaust fan chamber as noted above, the exhaust fan chamber can be formed in such a suitable shape as to achieve optimal performance of the exhaust fan. Thus, air within the engine cover can be efficiently sucked into the exhaust fan chamber, and then, the air having been sucked into the exhaust fan chamber can be efficiently discharged to outside of the exhaust fan chamber and then to outside of the engine cover.

Like the conventionally-known counterparts, the outboard engine unit of the present invention includes the engine accessories above the upper side of the engine body, such as a throttle body and an electric power generator. Air having been heated by the engine would stay or accumulate in an upper interior portion of the engine cover. However, in the present invention, where the air intake port and exhaust outlet port are provided in an upper interior portion of the engine cover, the heated air, having accumulated in the upper interior portion of the engine cover can be promptly discharged or removed from the engine cover at the time of hot reactivation. The term "hot reactivation" refers to reactivating the engine after deactivation of the engine but before the engine is cooled. Thus, the present invention can cool, with an enhanced efficiency, the engine accessories provided above the engine but below the belt cover.

Further, because the exhaust fan chamber is provided over the belt cover while the drive belt etc. are provided under the belt cover, the exhaust fan chamber can be partitioned by the belt cover from the drive belt etc., so that flows of the air sucked into the exhaust fan chamber can be prevented from being disturbed by operating movement or rotation of the drive belt etc. As a result, the air within the engine cover can be even more efficiently discharged to outside of the engine cover.

Preferably, in the outboard engine unit of the present invention, the exhaust outlet port and the exhaust opening are in communication with each other via an exhaust passageway provided in an upper portion of the engine cover. Because the exhaust passageway is provided in the upper portion of the engine cover, it can be disposed over the exhaust outlet port. Thus, air, having been discharged upwardly through the exhaust outlet port, can be smoothly directed into the exhaust passageway. In this way, the air can be discharged even more smoothly to the outside of the engine cover through the exhaust opening formed in the upper portion of the engine cover.

Further, preferably, in the outboard engine unit of the present invention, the fan cover has a height difference such that the exhaust fan chamber has a generally scroll (or spiral) shape. Thus, because of the scroll shape, air can be smoothly sucked from within the engine cover into the exhaust fan chamber. In this way, the air can be discharged even more smoothly to the outside of the engine cover.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

A preferred embodiment of the present invention will be described in detail below, by way of example only, with reference to the accompanying drawings, in which.

DETAILED DESCRIPTION OF THE PREFERRED EMBODIMENT

Figure 1:
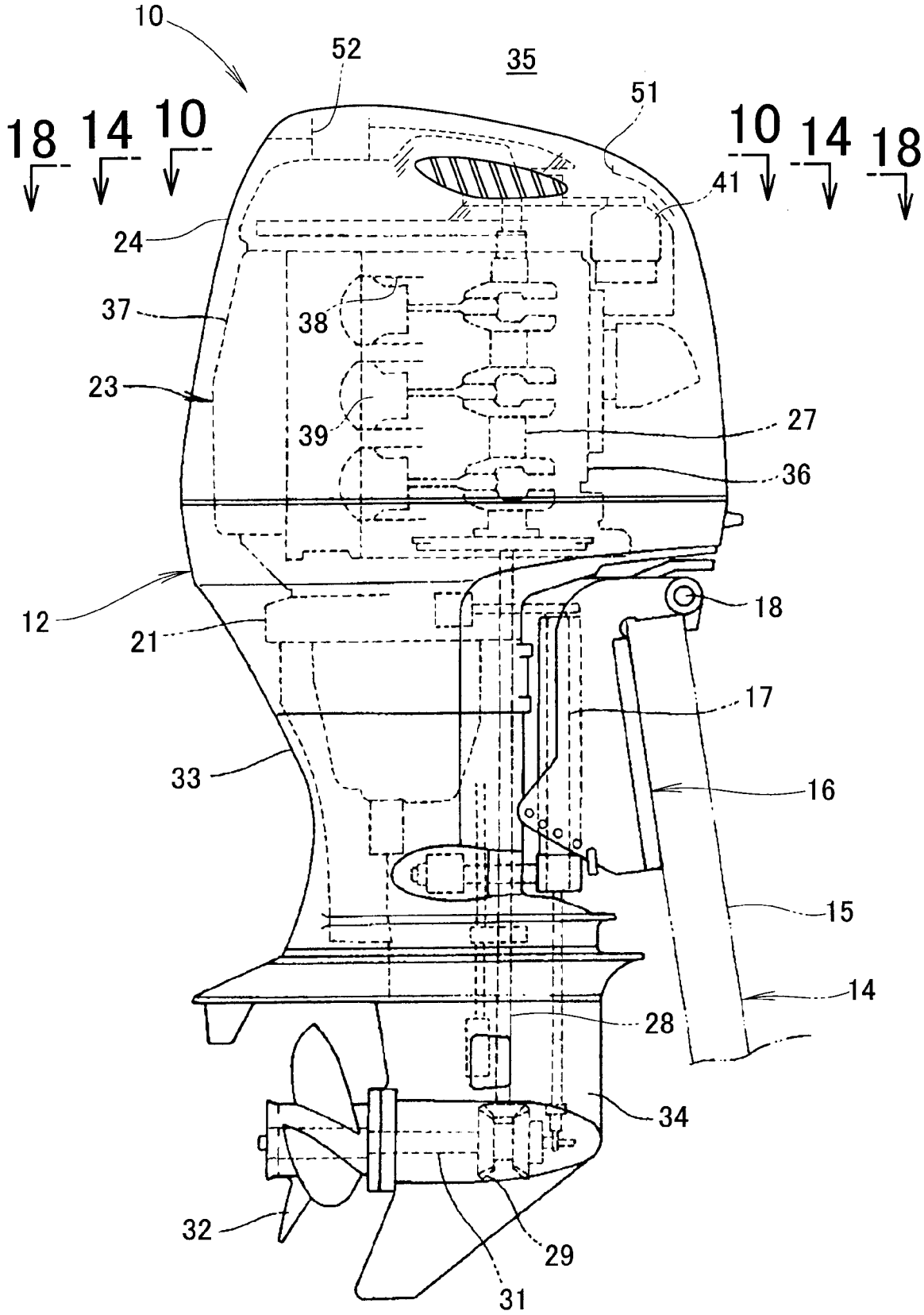
FIG. 1 is a side view showing an outboard engine unit according to an embodiment of the present invention.

Reference is now made to FIG. 1 showing in side elevation an outboard engine unit 10 according to an embodiment of the present invention. As shown, the outboard engine unit 10 comprises an outboard engine unit body 12, and a mounting section 16 provided on the outboard engine unit body 12 and detachably attachable to a hull or body (more specifically, stern 15) of a watercraft. The mounting section 16 includes a swivel shaft 17 via which the outboard engine unit body 12 is pivotable in a horizontal direction, and a tilt shaft 18 via which the outboard engine unit body 12 is pivotable in an up-down or vertical direction.

The outboard engine unit body 12 includes: a mount case 21 provided on the mounting section 16; an engine 23 mounted on an upper portion of the mount case 21; an engine cover 24 covering the engine 23; a drive shaft 28 connected coaxially with a crank shaft 27 of the engine 23; a gear mechanism 29 to which rotation of the engine 23 (crankshaft 27) is transmitted; a propeller 32 to which rotation of the gear mechanism 29 is transmitted via a propeller shaft 31; an exhaust section (ventilation section) 51 for discharge air from within the engine cover 24 to the outside 35; and an air intake section 52 for directing air from the outside 35 of the engine cover 24 to the engine 23.

The drive shaft 28 is covered with an extension case 33 provided under the mount case 21, and the gear mechanism 29 and the propeller shaft 31 are covered with a gear case 34 provided under the extension case 33.

The engine 23 includes a cylinder block 36 constituting an engine body, a head cover 37, the crankshaft 27, a cylinder 38, a piston 39, engine accessories 41, etc.

By activation of the engine 23, rotation of the engine 23 is transmitted to the propeller 32 via the drive shaft 28, gear mechanism 29 and propeller shaft 31, so that the propeller 32 rotates to cause the watercraft body 14 slidingly travels along the surface of water.

Figure 2:
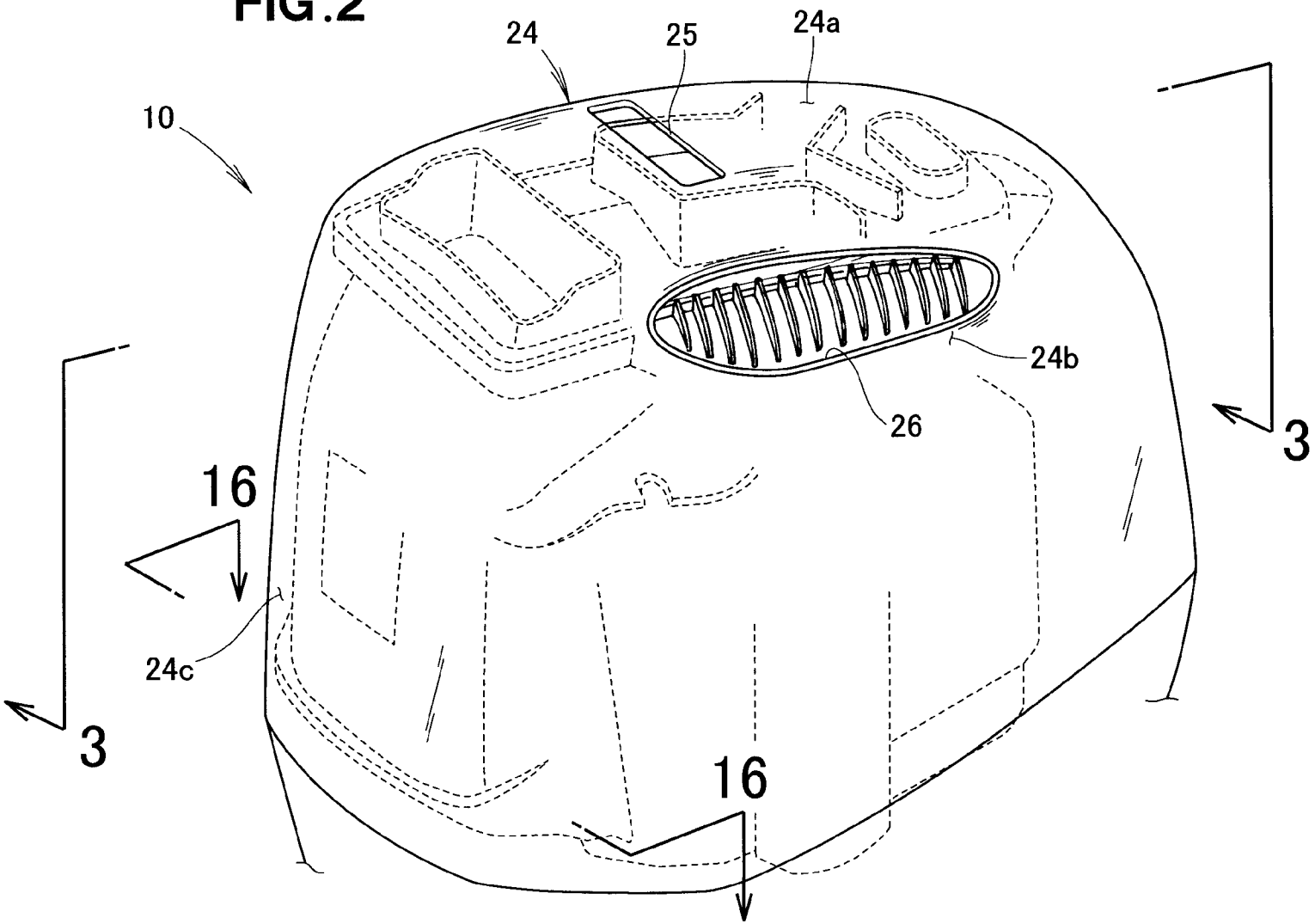
FIG. 2 is a perspective view showing an engine cover of the outboard engine unit of the present invention.
Figure 10:
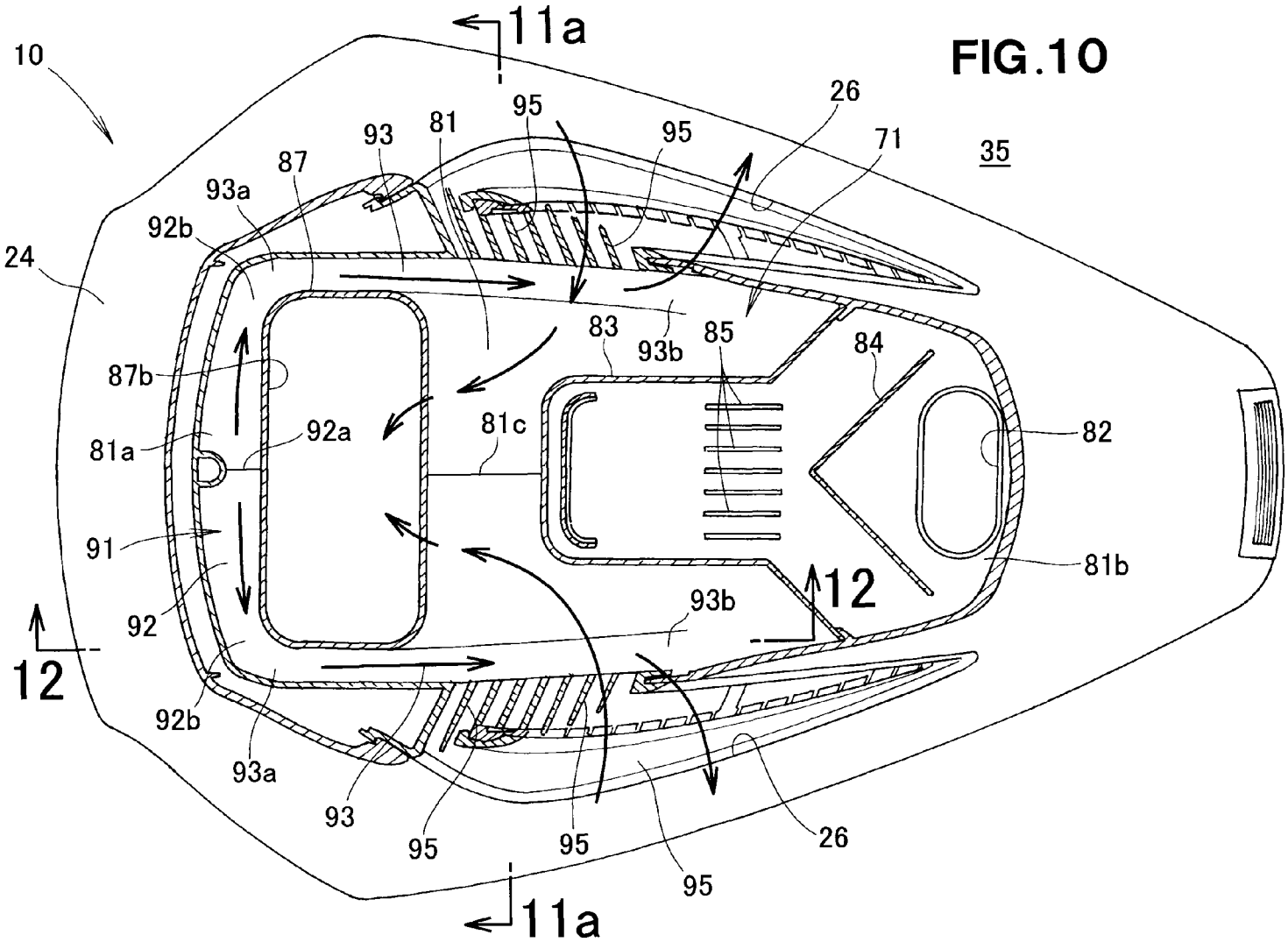
FIG. 10 is a sectional view taken along line 10-10 of FIG. 1.

As shown in FIG. 2, the engine cover 24 has an exhaust opening 25 formed in an upper portion 24*a* thereof, and air intake openings 26 formed in opposite (i.e., left and right) side portions thereof. Only one of the opposite-side air intake openings 26 is shown in FIG. 2, while the other air intake opening 26 is shown in FIG. 10. The exhaust opening 25 and air intake openings 26 will be detailed later.

Figure 3:
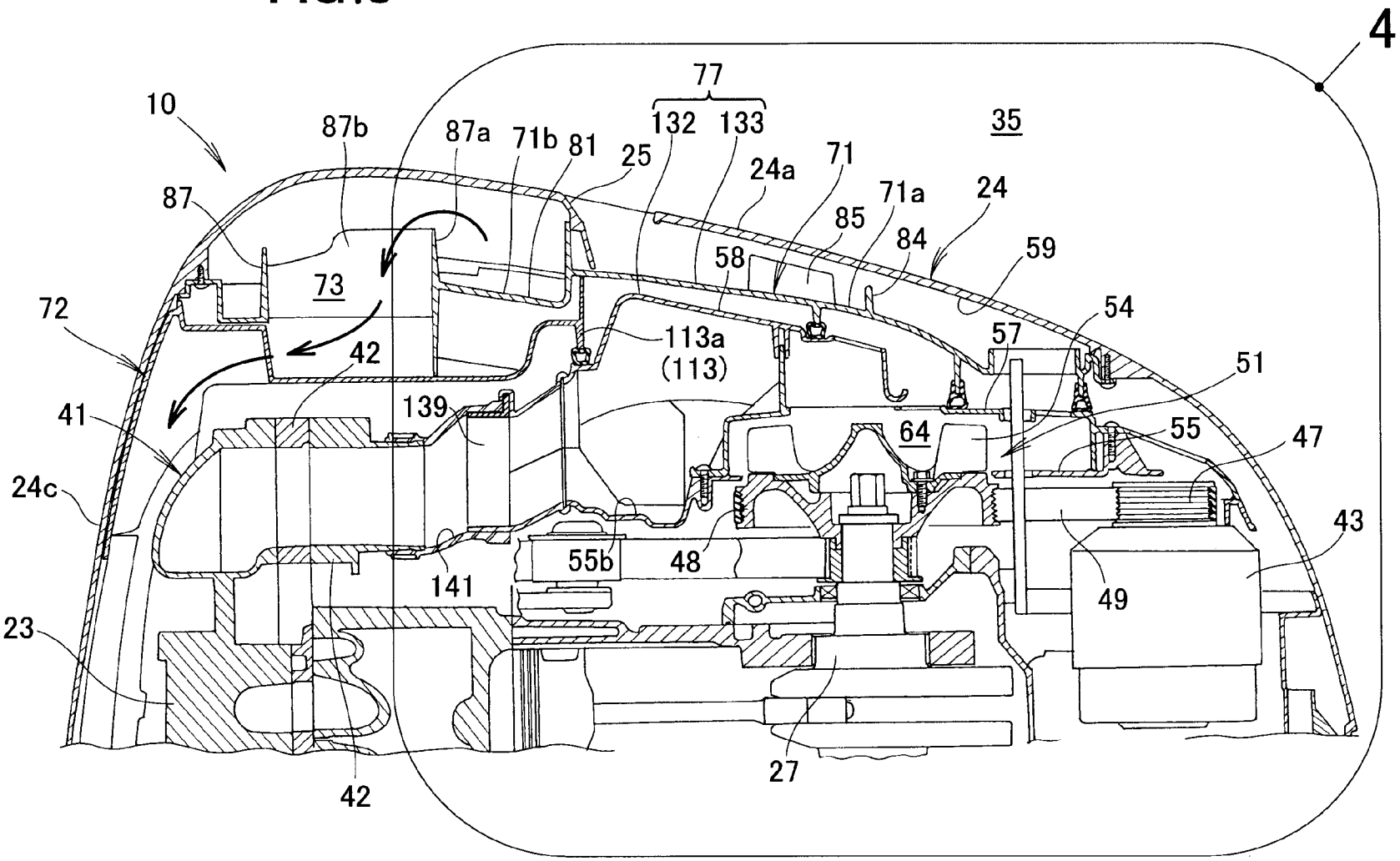
FIG. 3 is a sectional view taken along line 3-3 of FIG. 2.

As shown in FIG. 3, the engine accessories 41 include a throttle body 42 communicating with a combustion chamber of the engine 23, an electric power generator 43 provided on an opposite side from the throttle body 42, and an exhaust fan 54 provided between the power generator 43 and the throttle body 42.

Figure 4:
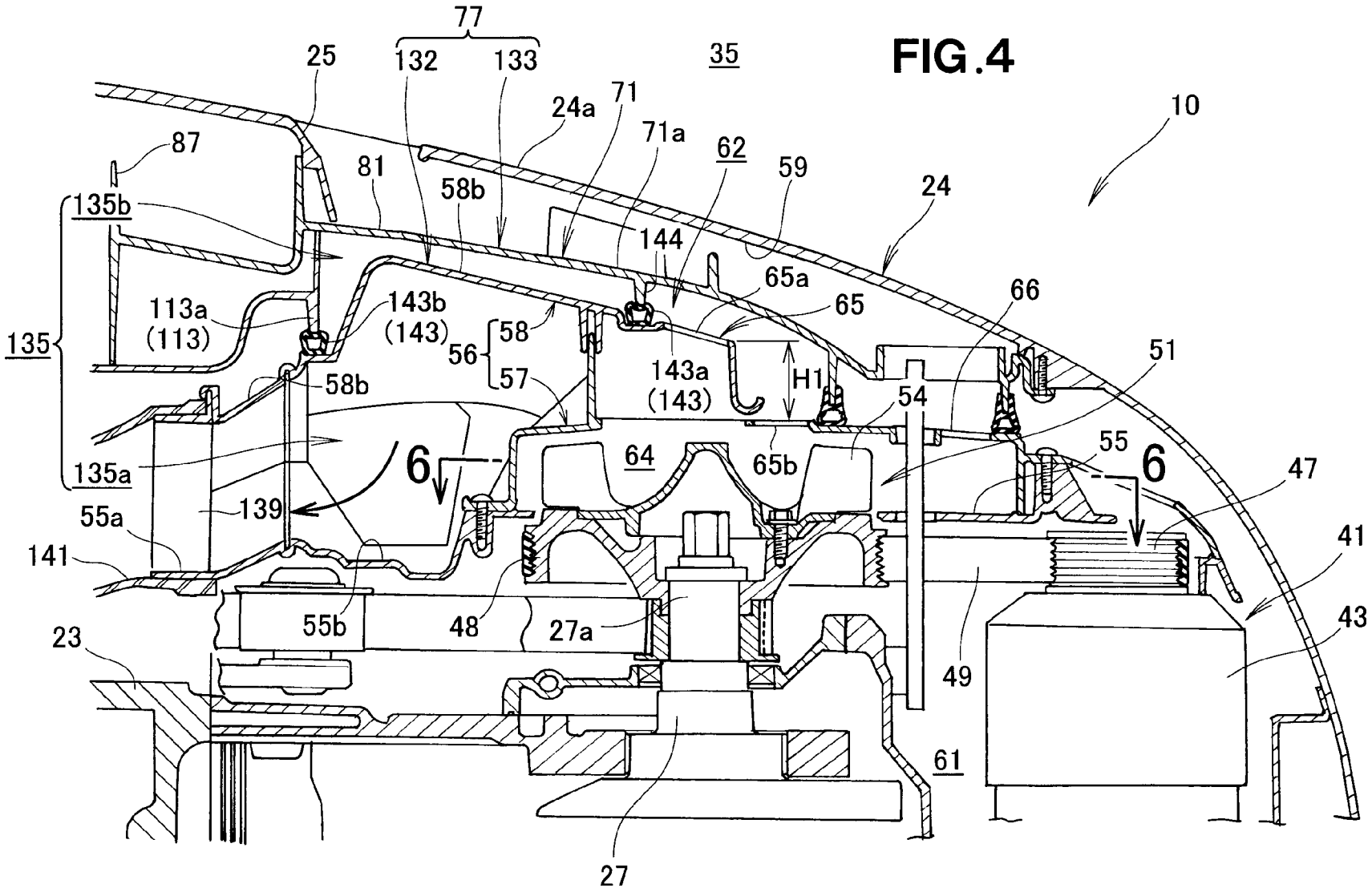
FIG. 4 is an enlarged view of a section of the outboard engine unit encircled at 4 in FIG. 3.

Further, as shown in FIG. 4, a drive belt 49 for driving the engine accessories 41 is wound at its opposite end portions on a driven pulley 47 and a driving pulley 48 of the power generator 43. Rotation of the driving pulley 48 is transmitted to the driven pulley 47 via the drive belt 49, and the driving pulley 48 is mounted on an upper end portion 27*a* of the crankshaft 27. Thus, as the crankshaft 27 rotates, the driving pulley 48 rotates, and such rotation of the driving pulley 48 is transmitted to the driven pulley 47 via the drive belt 49 so that the power generator 43 is driven by the rotation of the driven pulley 47.

Figure 5:
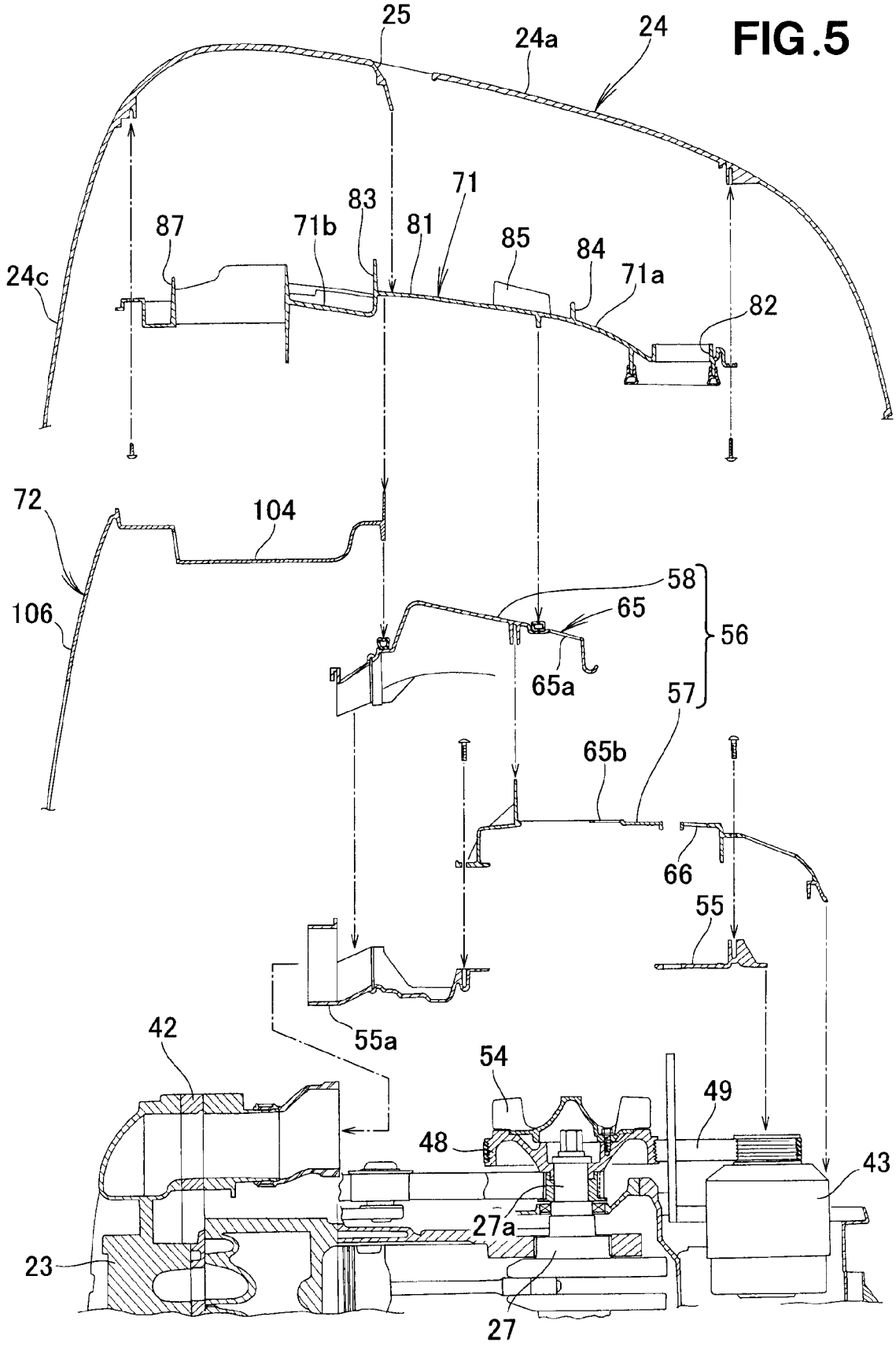
FIG. 5 is an exploded sectional view of the outboard engine unit of FIG. 3.

As shown in FIGS. 4 and 5, the exhaust section 51 includes the exhaust fan 54 mounted coaxially on the driving pulley 48, a belt cover 55 covering an upper portion of the drive belt 49, a fan cover 56 provided over the belt cover 55, and an exhaust passageway 59 for directing air from within the engine cover 24 to the outside.

As the driving pulley 48 rotates, the exhaust fan 54 rotates. The exhaust fan 54 is a fan for discharging air from within the engine cover 24 to the outside 35.

The belt cover 55, covering the upper portion of the drive belt 49, also covers an upper portion of a part of the power generator 43 and has a rear end portion 55*a* located adjacent to the throttle body 42. The interior of the engine cover 24 is partitioned into an engine room 61 and air intake/exhaust chamber 62 by the belt cover 55 being provided within the engine cover 24.

The engine room 61 is a space provided under the belt cover 55 for accommodating therein the engine 23. The air intake/exhaust chamber 62 is a space provided over the belt cover 55 for accommodating therein the exhaust passageway 59 and air intake passageway 73. The engine room 61 and the air intake/exhaust chamber 62 are in communication with each other via a not-shown space.

The fan cover 56 is provided over the belt cover 55, and the fan cover 56 comprises a first fan cover member 57 provided over the belt cover 55 and a second fan cover member 58 provided over an a rear part of the first fan cover member 57. Thus, an exhaust fan chamber 64 is defined with the belt cover and the first and second fan cover members 57 and 58 of the fan cover 56, and this exhaust fan chamber 64 is partitioned off from a remaining interior space of the engine cover 24.

The belt cover 55 and the fan cover 56 are provided independently of the engine 23 by being provided over the engine 23 in spaced-apart relation to the engine 23. Thus, the belt cover 55 and the fan cover 56 can be formed in any desired shapes without being influenced by the outer shape of the engine 23. Because any desired shapes can be chosen for the belt cover 55 and the fan cover 56 like this, undesired gaps and uneven concave-convex portions can be removed from the exhaust fan chamber 64.

By undesired gaps and uneven concave-convex portions being removed from the exhaust fan chamber 64 as noted above, the exhaust fan chamber 64 can be formed in such a suitable shape as to achieve optimal performance of the exhaust fan 54. Thus, in the instant embodiment of the outboard engine unit, air within the air intake/exhaust chamber 62 can be efficiently sucked into the exhaust fan chamber 64, and then, the air having been sucked into the exhaust fan chamber 64 can be efficiently discharged to outside of the exhaust fan chamber 64 and then to the outside 35 of the engine cover 24.

Further, because the exhaust fan chamber 64 is provided over the belt cover 55 while the drive belt 49 and the driving pulley 48 are provided under the belt cover 55, the exhaust fan chamber 64 is partitioned off from the drive belt 49 and the driving pulley 48 by the belt cover 55, so that flows of the air sucked into the exhaust fan chamber 64 can be prevented from being disturbed by operating movement or rotation of the drive belt 49 and driving pulley 48. As a result, the air within the air intake/exhaust chamber 62 can be even more efficiently discharged to outside of the engine cover 24.

Figure 7:
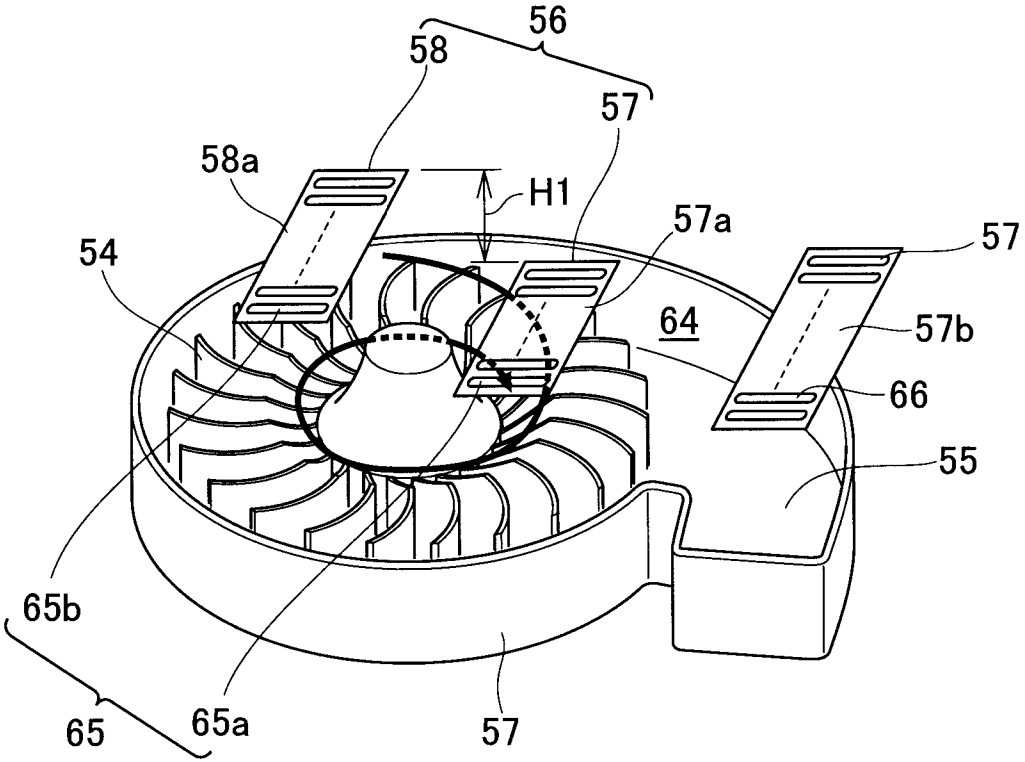
FIG. 7 is a perspective view showing an exhaust fan chamber and an exhaust fan of FIG. 4.

As shown in FIG. 7, the second fan cover member 58 is disposed higher by a distance H1 than the first fan cover member 57. Namely, the fan cover 56 has the level or height difference H1 defined with the first and second fan cover members 57 and 58. The exhaust fan chamber 64 is partitioned off from the engine room 61 and the air intake/exhaust chamber 62.

Figure 6:
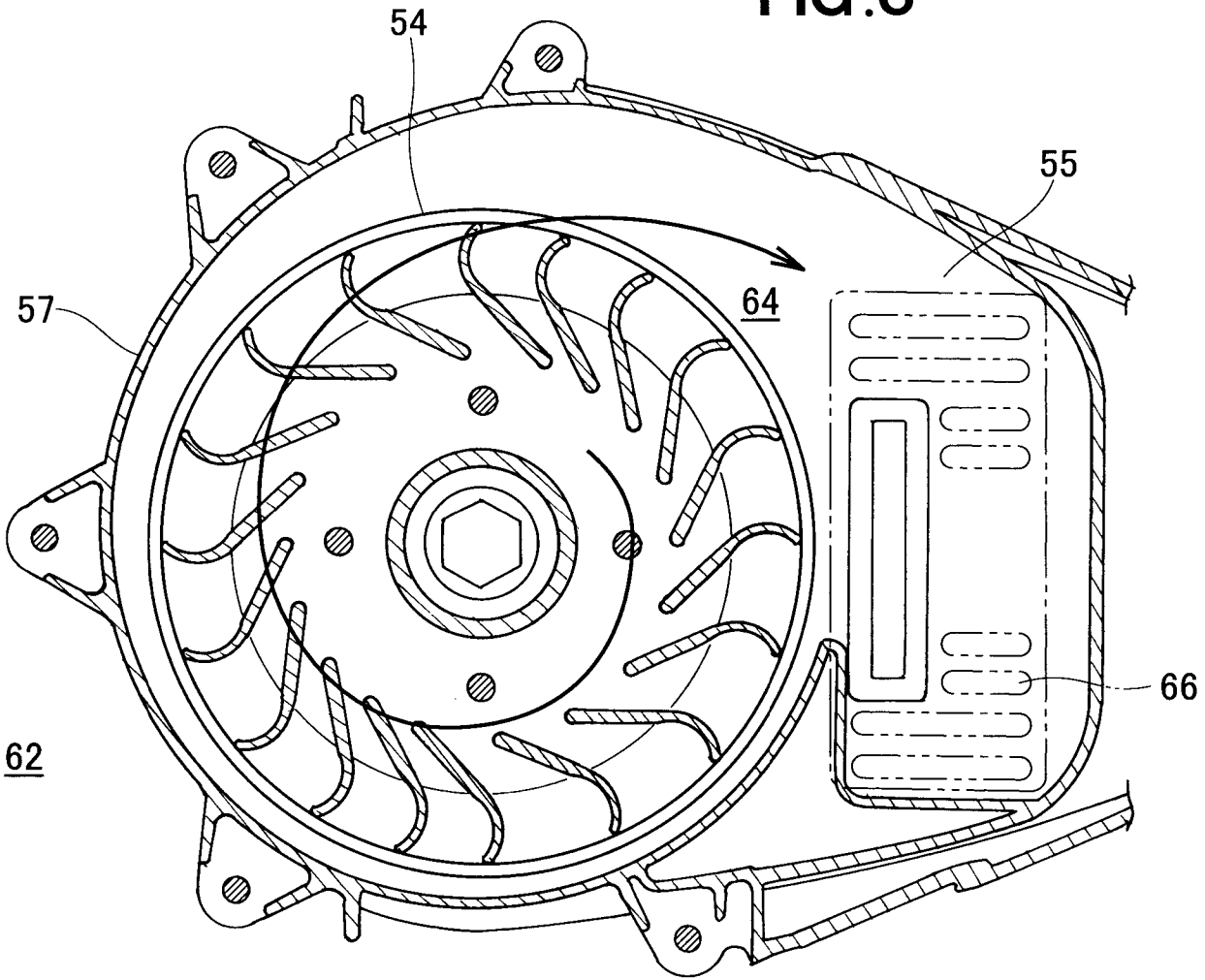
FIG. 6 is a sectional view taken along line 6-6 of FIG. 4.

As shown in FIG. 6, the exhaust fan 54 is rotatably accommodated in the exhaust fan chamber 64. Air within the exhaust fan chamber 64 is directed to exhaust outlet ports 66 as indicated by an arrow in the figure by the exhaust fan 54 being rotated in the exhaust fan chamber 64.

As shown in FIGS. 4 and 7, the first and second fan cover members 57 and 58 have air intake ports 65 (65*a* and 65*b*) formed therein for communicating the air intake/exhaust chamber 62 with the exhaust fan chamber 64. More specifically, a plurality of the first air intake ports 65*a* are formed in a substantial middle part 57*a* of the first fan cover member 57, while a plurality of the second air intake ports 65*b* are formed in a front part 58*a* of the second fan cover member 58. The first and second air intake ports 65*a* and 65*b* are disposed over the exhaust fan 54.

Because the height difference H1 is provided between the first and second fan cover members 57 and 58 and the first and second fan cover members 57 and 58 have the first and second air intake ports 65*a* and 65*b* as noted above, the exhaust fan chamber 64 has a generally scroll (or spiral) shape, so that air can be smoothly sucked into the exhaust fan chamber 64.

Further, the first fan cover member 57 has the exhaust outlet ports 66 formed in a front part 57*b* thereof for communicating the exhaust fan chamber 64 with the exhaust passageway 59. The exhaust passageway 59 is defined with an upper portion 24*a* of the engine cover 24 and a front half portion 71*a* of an air guide 71 so as to extend along the upper portion 24*a* of the engine cover 24.

The exhaust passageway 59 is in communication with the outside 35 of the engine cover 24 via the exhaust opening 25 formed in the upper portion 24*a* of the engine cover 24. Namely, the exhaust fan chamber 64 is in communication with the outside 35 of the engine cover 24 via the exhaust outlet ports 66, exhaust passageway 59 and exhaust opening 25. Thus, by rotation of the exhaust fan 54, air within the air intake/exhaust chamber 62 can be sucked into the exhaust fan chamber 64 via the exhaust opening 25. Further, the air having been sucked into the exhaust fan chamber 64 is directed to outside of the exhaust fan chamber 64, i.e. to the exhaust passageway 59, via the exhaust outlet ports 66, after which the air is discharged to the outside 35 of the engine cover 24 via the exhaust passageway 59.

As noted previously, the air intake/exhaust chamber 62 is in communication with the engine room 61 via the not-shown space. Thus, air within the air intake/exhaust chamber 62 and engine room 61 can be reliably discharged to the outside 35 of the engine cover 24 by rotation of the exhaust fan 54.

Further, because the exhaust fan chamber 64 has the scroll (or spiral) shape with the height difference H1 provided in the fan cover 56, the air within the air intake/exhaust chamber 62 can be sucked even more smoothly into the exhaust fan chamber 64 via the first and second air intake ports 65*a* and 65*b*, and thus, can be discharged even more smoothly to the outside 35 of the engine cover 24. In this way, the air within the air intake/exhaust chamber 62 and engine room 61 can be efficiently discharged to the outside 35 of the engine cover 24 via the air intake/exhaust chamber 62, as a result of which the air within the air intake/exhaust chamber 62 and engine room 61 can be maintained at optimal temperature.

Like the conventionally-known counterparts, the outboard engine unit 10 includes the engine accessories 41 above an upper side of the engine body, such as the throttle body 42 communicating with the combustion chamber of the engine 23 and an electric power generator 43. Air having been heated by the engine 23 would stay or accumulate in an upper interior portion of the engine cover 24. Thus, with the air intake ports 65 and exhaust outlet ports 66 provided in an upper portion of the engine cover 24, the heated air, having accumulated in the upper interior space of the engine cover 24 (i.e., air intake/exhaust chamber 62), can be promptly discharged or removed at the time of hot reactivation. The term "hot reactivation" refers to reactivating the engine 23 after deactivation of the engine 23 but before the engine 23 is cooled. Thus, the instant embodiment of the outboard engine unit can cool, with an enhanced efficiency, the accessories 41 provided above the engine 23 but below the belt cover 55.

In addition, by the provision of the exhaust outlet ports 66 over the exhaust fan 54, the instant embodiment can discharge the air upwardly through the exhaust outlet ports 66. Further, because the exhaust passageway 59 is provided in the upper portion 24*a* of the engine cover 24, it can be located over the exhaust outlet ports 66. Thus, the air, having been discharged upwardly through the exhaust outlet ports 66, can be smoothly directed into the exhaust passageway 59. In this way, the air can be discharged even more smoothly to the outside 35 of the engine cover 24 through the exhaust opening 25 formed in the upper portion of the engine cover 24.

Figure 8:
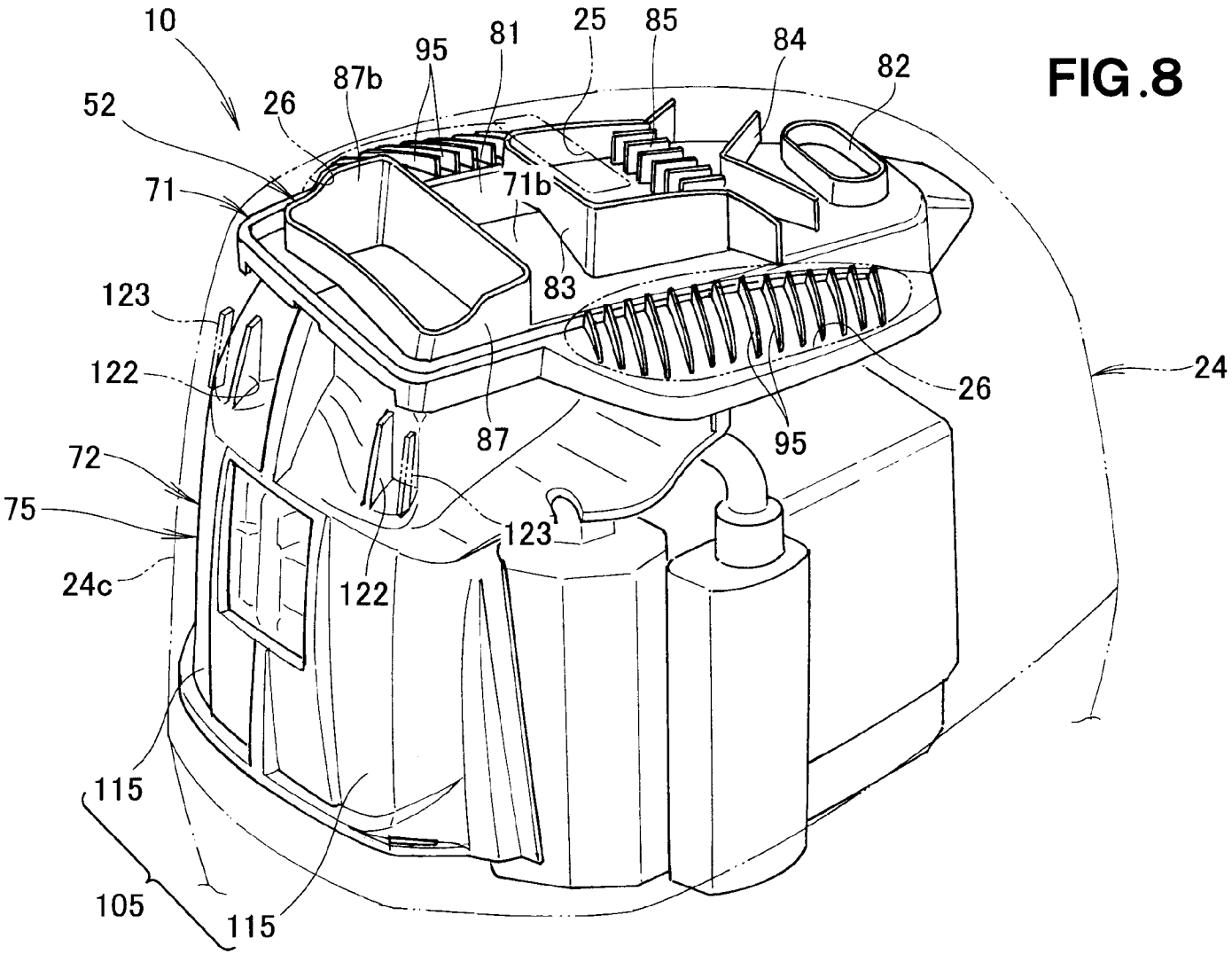
FIG. 8 is a perspective view showing an air intake section (air guide and rear duct) of the outboard engine unit.
Figure 9:
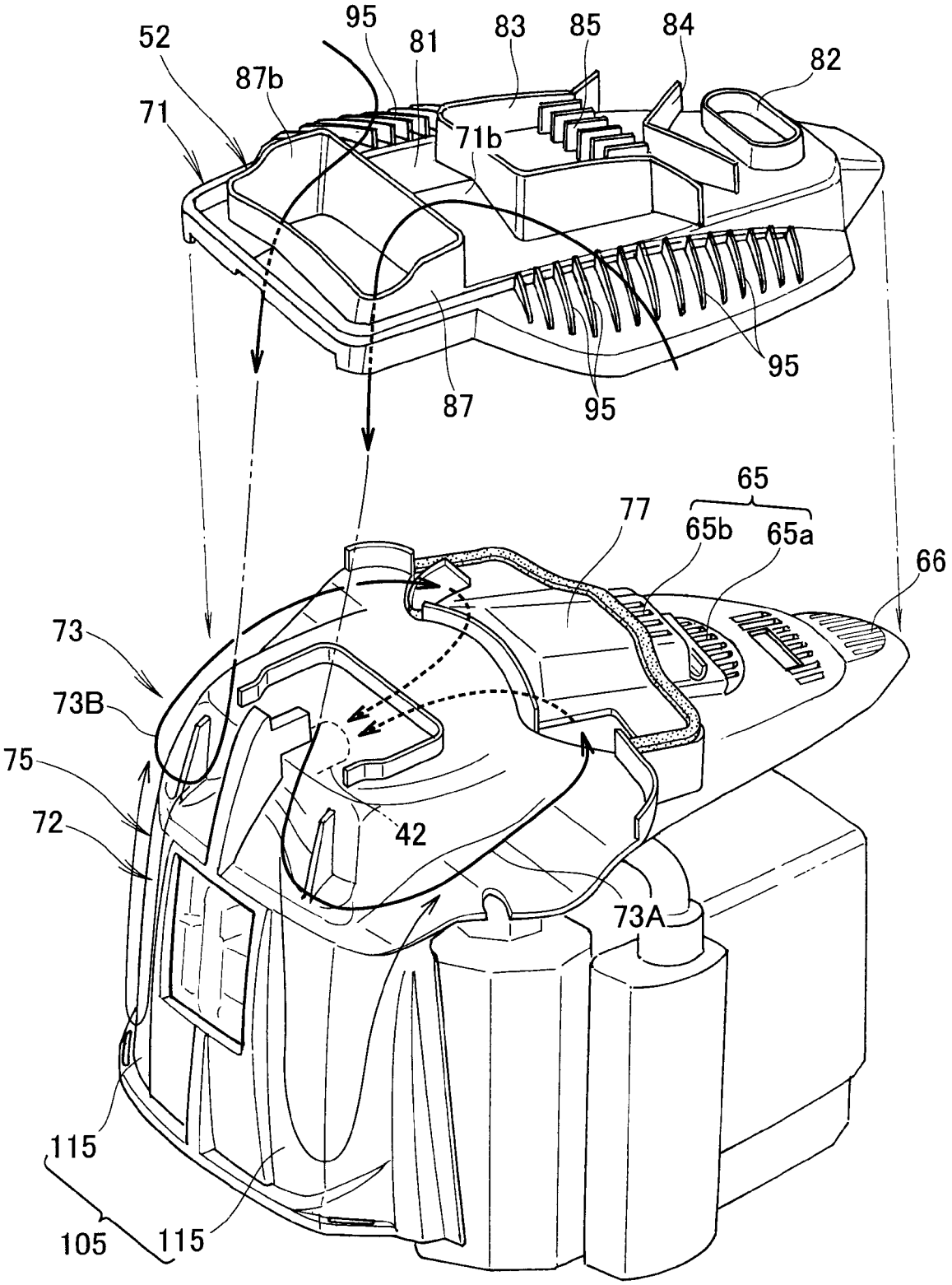
FIG. 9 is an exploded sectional view of the air intake section of FIG. 8.

As shown in FIGS. 8 and 9, the air intake section 52 includes the air intake passageway 73 for introducing air from outside of the engine cover 24 into the throttle body 42, drain/interference-type muffler 75 (comprising interference-type muffler sections 75A and 75B), and a silencer 77 provided downstream of the drain/interference-type muffler 75 and upstream of the throttle body 42.

The air intake passageway 73 is provided for directing air, sucked into the engine cover 24 through the air intake openings 26 formed in the opposite (left and right) side portions of the engine cover 24, into the throttle body 42. The air intake passageway 73 is defined with the engine cover 24, air guide 71, rear duct 72, etc., and comprises a pair of air intake passageway sections 73A and 73B as shown in FIG. 9

One of the air intake passageway sections 73A is provided for directing air from one of the side air intake openings 26 to the throttle body 42. The one air intake passageway section 73A includes one of the drain/interference-type muffler sections 75A that is provided at an intermediate or enroute position of the air intake passageway section 73A, and the silencer 77 provided upstream of the one drain/interference-type muffler section 75A and upstream of the throttle body 42.

The other air intake passageway section 73B is provided for directing air from the other air intake opening 26 to the throttle body 42. The other air intake passageway section 73B includes the other drain/interference-type muffler section 75B (see FIG. 16) that is provided at an enroute position of the air intake passageway section 73B, and the silencer 77 provided downstream of the other drain/interference-type muffler section 75B and upstream of the throttle body 42.

The same silencer 77 is shared between the two air intake passageway sections 73A and 73B. Thus, air suction noise in the one air intake passageway section 73A can be effectively reduced by a combination of the one drain/interference-type muffler section 75A (see FIG. 16) and the silencer 77, while air suction noise in the other air intake passageway section 73B can be effectively reduced by a combination of the other drain/interference-type muffler section 75B (see FIG. 16) and the silencer 77. In this way, the instant embodiment of the outboard engine unit can sufficiently reduce air suction noise produced during running of the engine 23. The drain/interference-type muffler 75 (interference-type muffler sections 75A and 75B) and the silencer 77 will be detailed later.

As shown in FIGS. 3 and 5, the air guide 71 is provided over the upper surfaces of the fan cover 56 and rear duct 72 and under the underside of the upper portion 24*a* of the engine cover 24. The air guide 71 includes a guide bottom section 81 covering the fan cover 56 and rear duct 72, a passage entrance 82 provided in a front end portion of the guide bottom section 81, a peripheral side wall 83 of the exhaust passageway 59 provided rearwardly of the passage entrance 82 (see also FIG. 9), and first and second guide plates 84 and 85 provided in the exhaust passageway 59. The passage entrance 82 is an entrance to the exhaust passageway 59.

The exhaust passageway 59 is defined between the engine cover 24 and the front half portion 71*a* of the air guide 71 by the peripheral side wall 83 closing a space between the upper portion 24*a* of the engine cover 24 and the guide bottom section 81. Further, with the first and second guide plates 84 and 85 provided in the exhaust passageway 59, the instant embodiment can smoothly guide air, directed from the exhaust fan 64 into the exhaust passageway 59, toward the exhaust opening 25.

As shown in FIG. 10, the air guide 71 further includes an air intake guide section 87 provided on a rear end portion of the guide bottom section 81, a drain groove 91 extending forward from a rear outer periphery of the air intake guide section 87, and a plurality of guide plates 95 provided, outside the drain groove 91 at positions corresponding to the side air intake openings 26, for separating water from air having been sucked in through the side air intake openings 26.

Note that, as air is sucked into the engine cover 24 through the air intake openings 26, water droplets and sprays, having accumulated around the air intake openings 26, may be undesirably sucked into the engine cover 24 together with air. The instant embodiment, however, can separate such water, having been sucked into the engine cover 24 together with the air, from the air by causing the water to contact the plurality of guide plates 95. In the instant embodiment, a shape, size, etc. of the air intake openings 26 are chosen in such a manner that intake resistance of the air would not increase due to the provision of the guide plates 95. The air, having been sucked into the engine cover 24 through the air intake openings 26, is directed to the air intake guide section 87 in a generally horizontal direction along the guide bottom section 81.

Further, as shown in FIGS. 3 and 10, the air intake guide section 87, disposed at an en route position of the air intake passageway 73, is a vertical cylindrical passageway provided on the rear end portion of the guide bottom section 81 and having an air intake port 87*b* at its upper end portion 87*a*. The air intake port 87*b* of the air intake guide section 87 is located above the guide bottom section 81, and a space above the guide bottom section 81 is in communication with a space below the guide bottom section 81 via the air intake guide section 87. Thus, the air sucked in through the air intake openings 26 is sucked into the air intake guide section 87 so that the air can be guided vertically downward as indicated by arrows in FIG. 3.

Flows of the air sucked in through the air intake openings 26 can be diverted, or changed in direction, by the air intake guide section 87 provided on the rear end portion of the guide bottom section 81 in the vertical orientation, during which time water contained in the air can be separated from the air by being caused to contact the air intake guide section 87. The air intake guide section 87 is shaped in such a manner that intake resistance of the air would not increase due to the provision of the air intake guide section 87. Namely, the air intake guide section 87 is constructed to separate water from the air sucked into the engine cover 24 through the air intake openings 26.

The water having been separated from the air by the air intake guide section 87 is directed to a later-described rear drain groove section 92 and the guide bottom section 81. The guide bottom section 81 extends in a downward slope of an inclination angle θ1 (see FIG. 12) from the rear end 81*a* toward the front end 81*b* thereof. The guide bottom section 81 also extends in a downward slope of an inclination angle θ2 (see FIG. 11) in a width direction of the outboard engine unit from its middle (i.e., widthwise middle) 81*c* toward the left and right sides thereof. Namely, the guide bottom section 81 is formed to slope downward from the air intake guide section 87 toward the air intake openings 26 in a region between the air intake openings 26 and the air intake guide section 87.

The drain groove 91 is provided in the guide bottom section 81, and it includes the rear drain groove section 92 provided immediately behind the air intake guide section 87, and side drain groove sections 93 provided adjacent to the opposite (i.e., left and right) sides of the air intake guide section 87 and extending forward along and beyond the opposite sides of the air intake guide section 87. The drain groove 91 is constructed to discharge the water, separated from the air by the air intake guide section 87, to the outside 35 of the engine cover 24 through the air intake openings 26.

Similarly to the aforementioned guide bottom section 81, the rear drain groove section 92 extends in a downward slope of the inclination angle θ2 (see FIG. 11) its middle (i.e., widthwise middle) 92*a* toward the left and right sides thereof. Thus, the rear drain groove section 92 can guide the water, separated from the air by the air intake guide section 87, to opposite (left and right) laterally-outer end portions 92*b* thereof as indicated by arrows in FIG. 10.

The left and right side drain groove sections 93 extend forward from the laterally-outer end portions 92*b* of the rear drain groove section 92 to substantial lengthwise middles (i.e., middles in the front-rear direction of the outboard engine unit) of corresponding ones of the air intake openings 26. Namely, each of the side drain groove sections 93 has a rear end portion 93*a* communicating with a corresponding one of the laterally-outer end portions 92*b* of the rear drain groove section 92, and a front end portion 93*b* of the located at the substantial lengthwise middle of the corresponding air intake opening 26. Thus, the water, directed to the rear drain groove section 92 after having been separated from the air by the air intake guide section 87, can be guided from the rear end portions 93*a* to the front end portions 93*b*.

Further, because the side drain groove sections 93 are located laterally outwardly of the widthwise middle 81*c* and the guide bottom section 81 also extends in a downward slope of the inclination angle θ2 from the widthwise middle 81*c* toward the left and right sides thereof (see FIG. 11), the water, directed to the guide bottom section 81 after having been separated by the from the air by the air intake guide section 87, can be guided from the rear end portions 93*a* to the front end portions 93*b* of the side drain groove sections 93.

Figure 12:
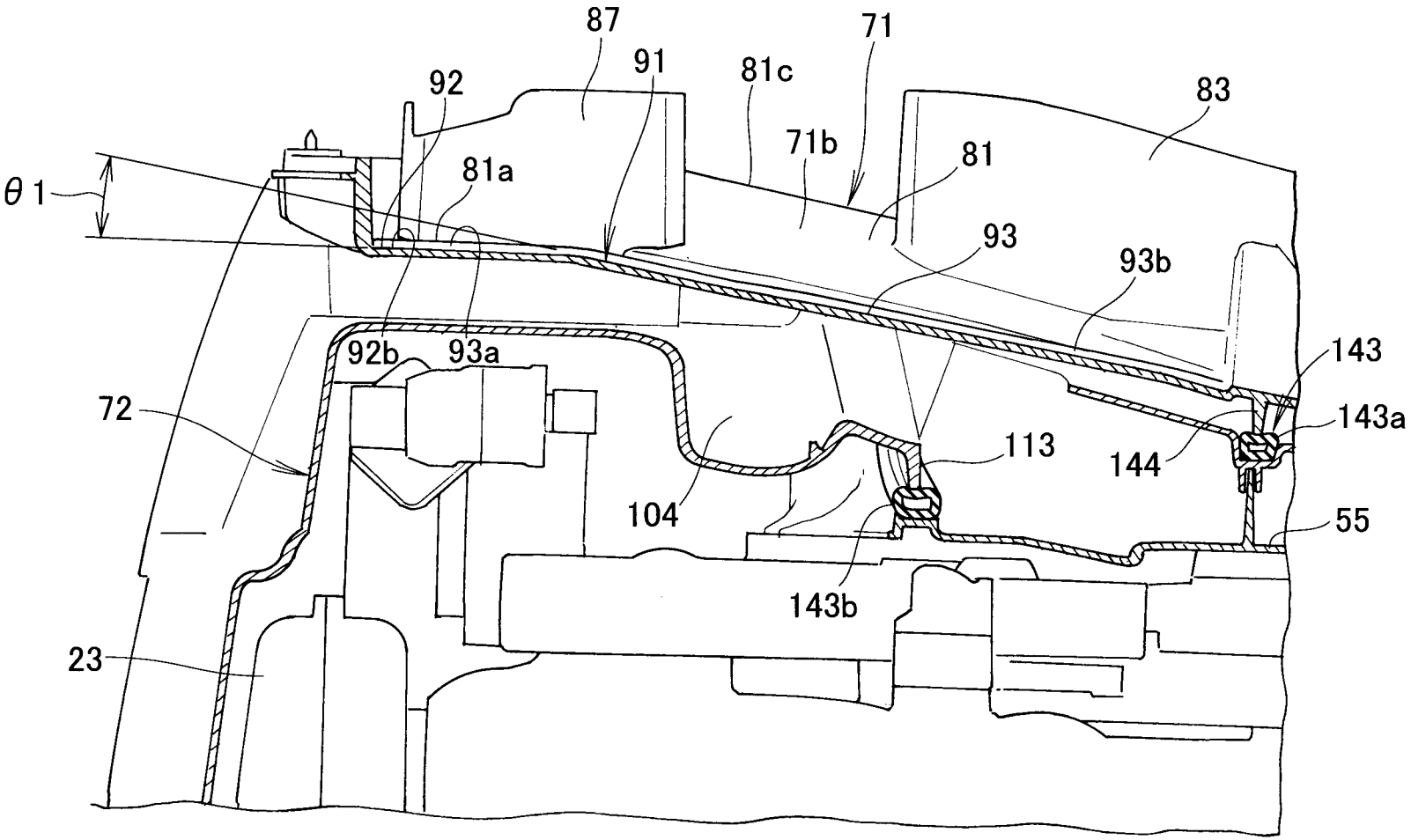
FIG. 12 is a sectional view taken along line 12-12 of FIG. 10.

As shown in FIGS. 10 and 12, the side drain groove sections 93 extend forward from the laterally-outer rear end portions 92*b* of the rear drain groove section 92. More specifically, similarly to the aforementioned guide bottom section 81, the side drain groove sections 93 extend in a downward slope of the inclination angle θ1 (see FIG. 12) 81*a* from the air intake guide section 87 toward the side air intake openings 26. Thus, water within the side drain groove sections 93 can be guided from the rear end portions 93*a* to the front end portions 93*b*.

As noted previously, the front end portions 93*b* of the side drain groove sections 93 are each located at the substantial middle, in the front-rear direction, of the corresponding air intake opening 26 (i.e., at the substantial lengthwise middle of the corresponding air intake opening 26). Thus, the water, directed from the rear drain groove section 92 and the guide bottom section 81 to the side drain groove sections 93, can be efficiently directed toward the air intake openings 26 via the side drain groove sections 93. In this way, the instant embodiment of the outboard engine unit can reliably discharge the water, separated by the air intake guide section 87, to the outside 35 of the engine cover 24 through the air intake openings 26.

Figure 11:
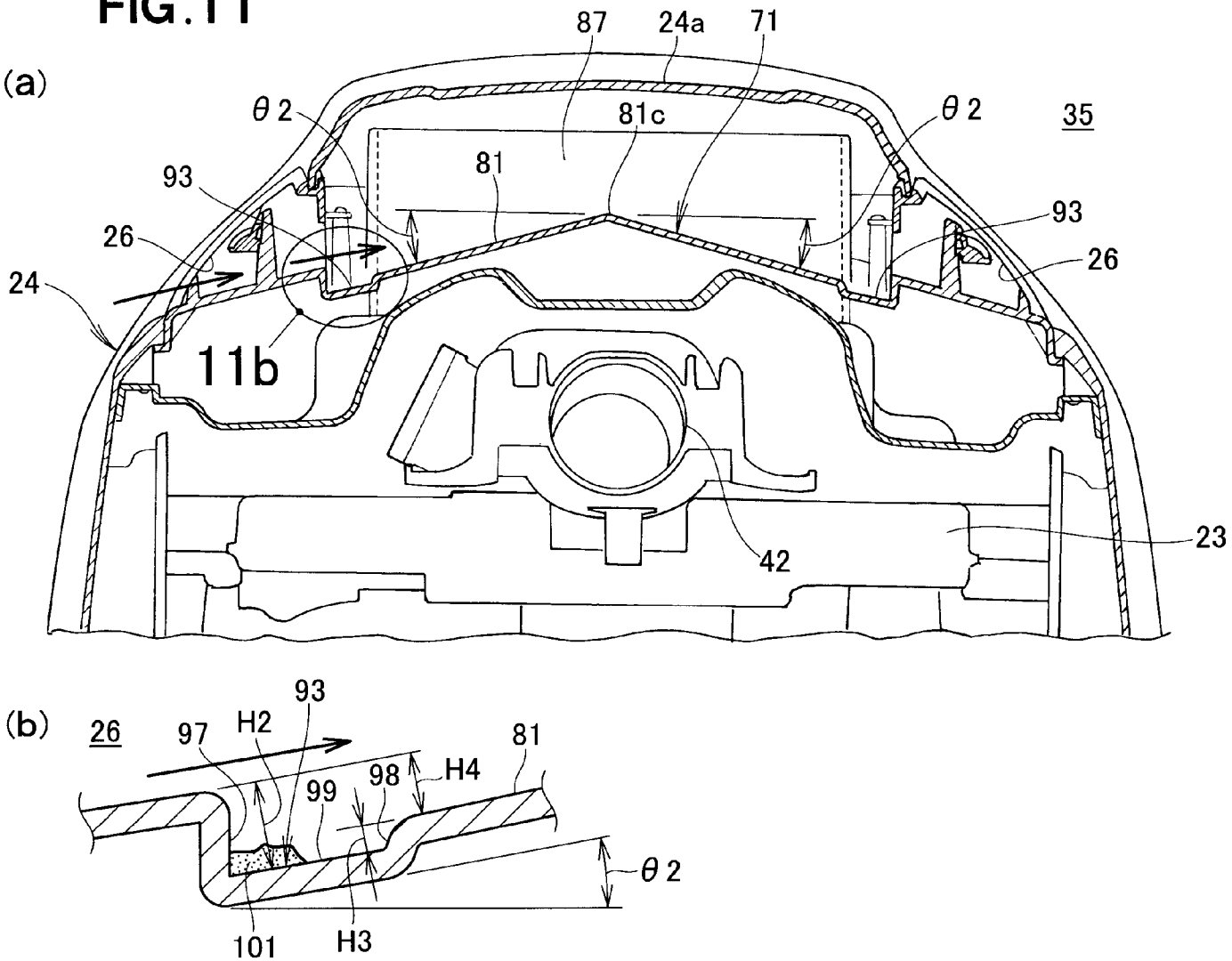
FIG. 11(*a*) is a sectional view taken along line 11*a*-11*a* of FIG. 10, and FIG. 11(*b*) is an expanded view of a section encircled at 11*b* in FIG. 11(*a*)

As shown in FIG. 11, each of the side drain groove sections 93 includes an outer groove wall 97 located adjacent to the corresponding air intake opening 26, an inner groove wall 98 opposed to and spaced from the outer groove wall 97, and a groove bottom portion 99 interconnecting respective lower end portions of the outer and inner groove walls 97 and 98. The side drain groove section 93 has a substantially U cross-sectional shape defined with the outer and inner groove walls 97 and 98 and groove bottom portion 99.

Similarly to the aforementioned guide bottom section 81, the groove bottom portion 99 extends in a downward slope of the inclination angle θ2 toward the left and right sides of the guide bottom section 81 (i.e., toward the guide plates 95). Further, in each of the side drain groove sections 93, the outer groove wall 97 has a height dimension H2 greater than a height dimension H3 of the inner groove wall 98; thus, the outer groove wall 97 is formed to be located higher than the inner groove wall 98 by a height dimension H4 (H2-H3). The reason why the outer groove wall 97 is formed to be located higher than the inner groove wall 98 by the height dimension H4.

As shown in FIG. 12, each of the side drain groove sections 93 is formed to have a groove depth gradually decreasing in a direction from the air intake guide section 87 to the front end portion 93*b*; thus, the height dimension H2 (see (b) of FIG. 11) of the outer groove wall 97 gradually decreases in the direction from the air intake guide section 87 to the front end portion 93*b*. Because not only each of the side drain groove sections 93 extend in a downward slope of the inclination angle θ1 from the air intake guide section 87 toward the air intake opening 26 but also the height dimension H2 of the outer groove wall 97 gradually decreases in the direction from the air intake guide section 87 to the front end portion 93*b* as noted above, water within each of the side drain groove sections 93 can be reliably guided from the rear end portion 93*a* to the front end portion 93*b*.

The water having been guided to the front end portions 93*b* of the side drain groove sections 93 is discharged from the front end portions 93*b* to the outside 35 of the engine cover 24 via the guide plates 95 and air intake openings 26, as indicated by arrows in FIG. 10. In this way, the instant embodiment can reliably separate, from the air, the water sucked in through the air intake openings 26 together with the air.

The following explain the reason why the outer groove wall 97 is formed to be higher than the inner groove wall 98 by the height dimension H4 (see (b) of FIG. 11). As shown in FIG. 10 and (a) of FIG. 11, the air, sucked through the air intake openings 26 to the air intake guide section 87, flows over the side drain groove sections 93, intersecting the side drain groove sections 93, as indicated by arrows. The air thus flowing over the side drain groove sections 93 might undesirably kick up water present in the side drain groove sections 93 to outside of the side drain groove sections 93.

Therefore, in the instant embodiment, each of the outer groove walls 97 is formed to be higher than the inner groove wall 98 by the height dimension H4 as shown in (b) of FIG. 11. With such an arrangement, the water 101 present in the side drain groove sections 93 can be greatly separated from the air flowing over the side drain groove sections 93, and thus, the water can be prevented from being kicked up by the air, flowing over the side drain groove sections 93, to outside of the side drain groove sections 93. In this way, the instant embodiment of the outboard engine unit can efficiently guide the water, present in the side drain groove sections 93, toward the air intake openings 26 (namely, to the front end portions 93*b*) and then reliably discharge the water to the outside 35 of the engine cover 24 through the air intake openings 26.

As shown in FIG. 9, the rear duct 72 is provided underneath a rear half portion 71*b* of the air guide 71, and it is located downstream of the air intake guide section 87 and adjacent to a rear wall 24*c* (FIG. 8) of the engine cover 24.

Figure 13:
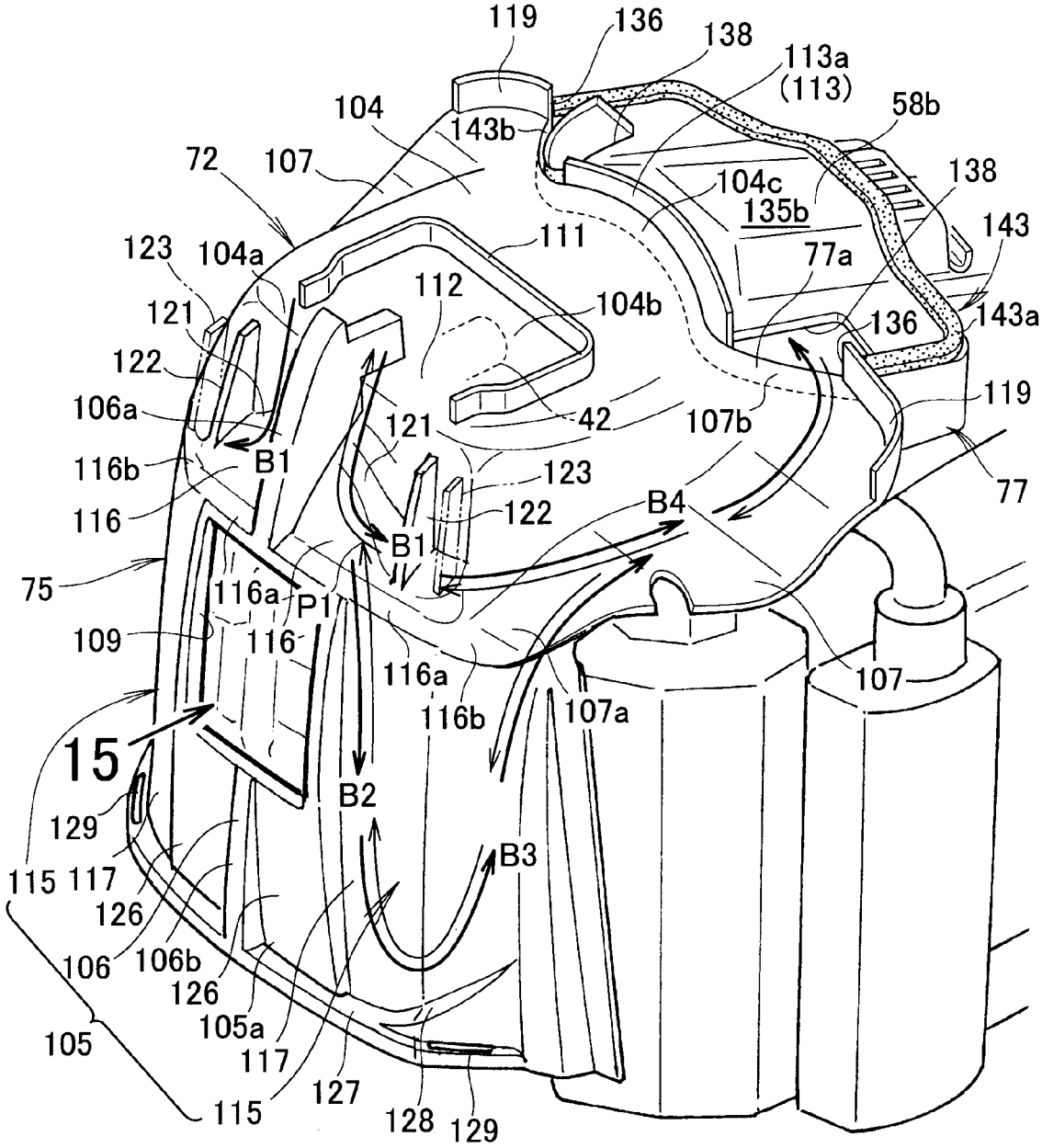
FIG. 13 is a perspective view showing the rear duct of FIG. 9.
Figure 14:
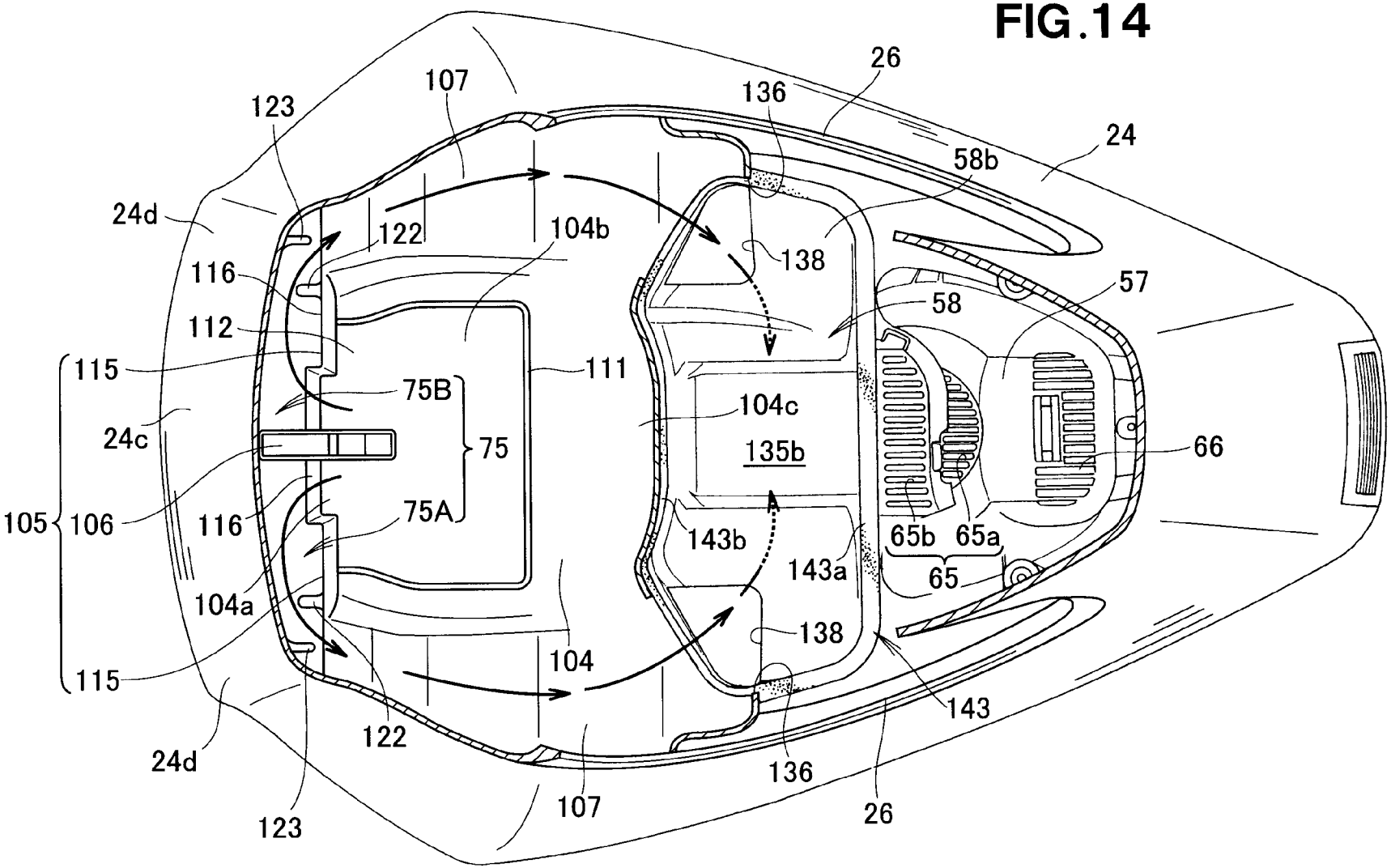
FIG. 14 is a sectional view taken along line 14-14 of FIG. 1.

Further, as shown in FIGS. 13 and 14, the air duct 72 includes a placement section 104 placing thereon the air intake guide section 87 of the air guide 71, a vertical duct section 105 extending downward from a rear end portion 104*a* of the placement section 104, and side guide sections 107 extending forward from opposite (left and right) side portions of the vertical duct section 105.

The placement section 104 covers an upper portion of the throttle body 42. The placement section 104 has a fitting wall 111 projecting upward from a rear half portion 104*b*, and a rear partitioning wall 113 (see also FIGS. 3 and 4) projecting upward from the front end edge 104*c*.

A guide opening portion 112 is formed by rear end portions of the fitting wall 111, and the air intake guide section 87 of the air guide 71 is fittingly engaged in the guide opening portion 112.

With the air intake guide section 87 thus fitted in the fitting wall 111, the air intake guide section 87 is in communication with the vertical duct section 105 via the guide opening portion 112. Thus, air directed to the air intake guide section 87 can be directed downward along the vertical duct section 105 via the guide opening portion 112.

Figure 15:
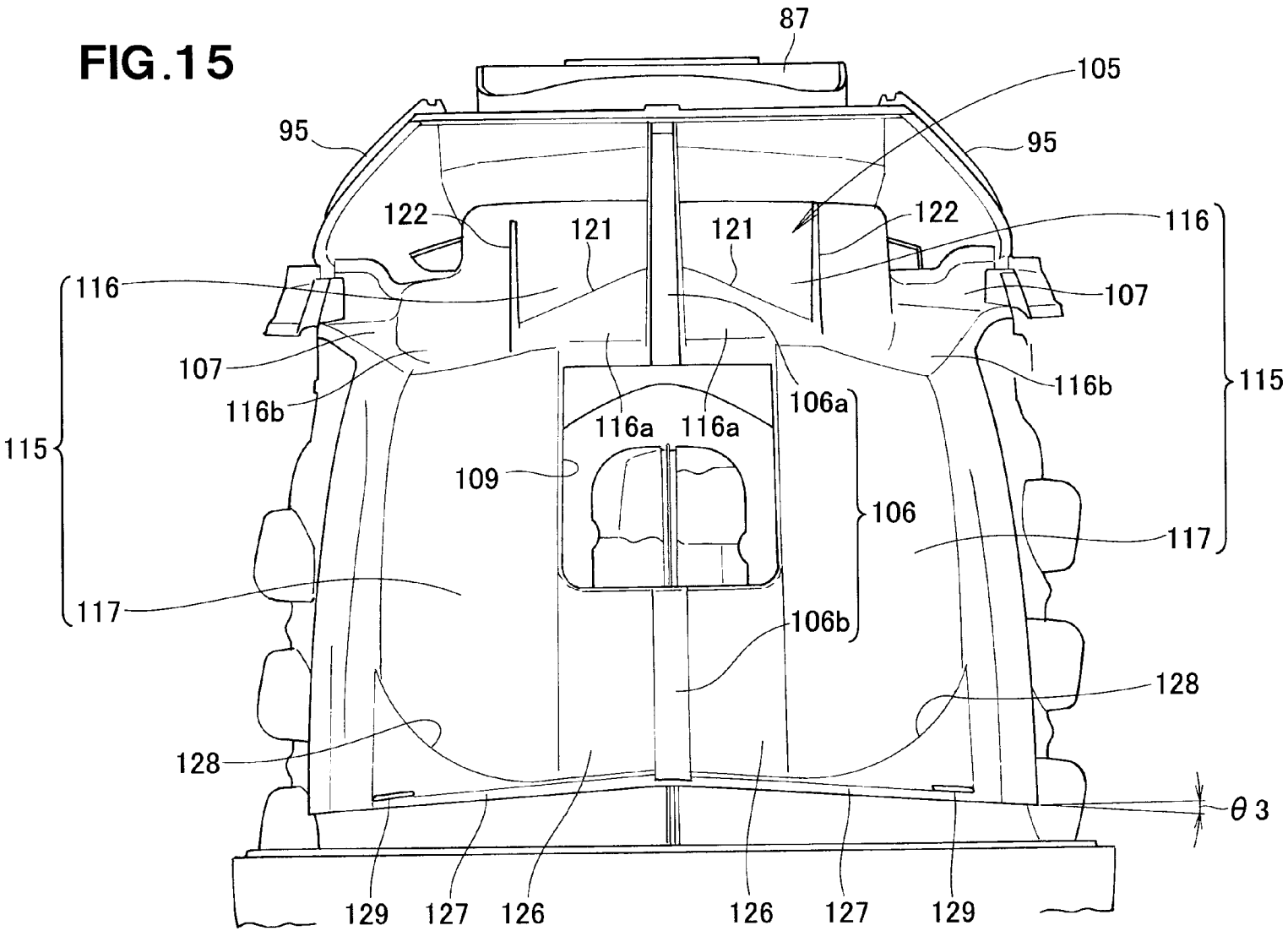
FIG. 15 is a view taken in a direction of arrow 15 in FIG. 13.
Figure 16:
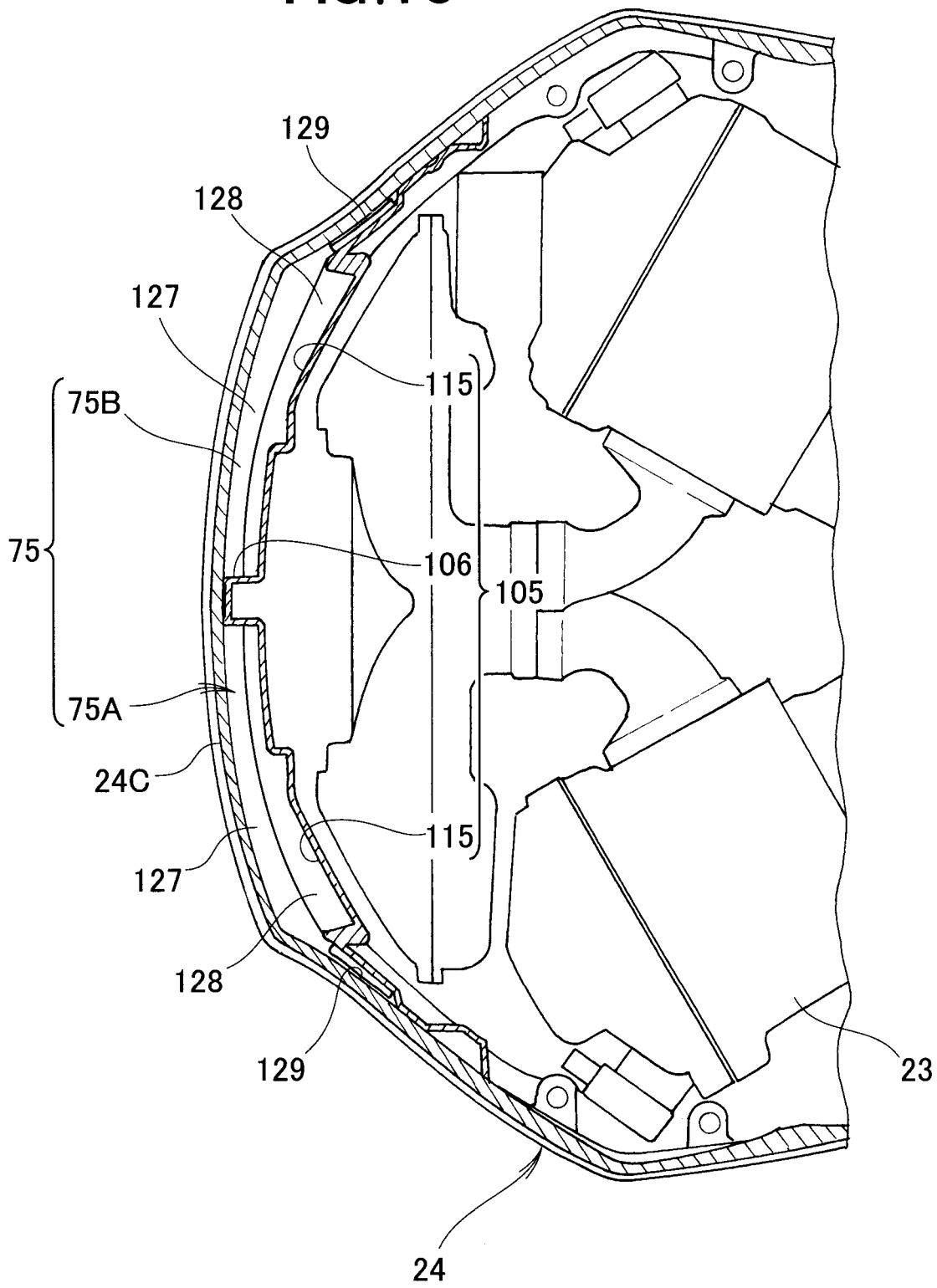
FIG. 16 is a sectional view taken along line 16-16 of FIG. 2.

As shown in FIGS. 13 and 15, the vertical duct section 105 is a vertical duct including a middle partitioning section 106 that extends vertically to horizontally partition the vertical duct section 105 into a pair of divided duct portions 115. The vertical duct section 105 is covered with the rear wall 24*c* of the engine cover 24, as shown in FIG. 16, so that the drain/interference-type muffler 75 is constructed of the vertical duct section 105 and the rear wall 24*c* of the engine cover 24.

As further shown in FIGS. 13 and 15, the middle partitioning section 106 includes an upper middle partitioning portion 106*a* extending downward from the rear end portion 104*a* of the placement section 104 to a rectangular opening 109, and a lower middle partitioning portion 106*b* extending downward from the rectangular opening 109 to a lower end portion 105*a* of the vertical duct section 105.

By the middle partitioning section 106 horizontally partitioning the vertical duct section 105, the vertical duct section 105 has the pair of divided duct portions 115. Thus, as air present in the air intake guide section 87 is guided downward to the vertical duct section 105 via the guide opening 112, flows of the air are divided into the two duct portions 115.

Each of the divided duct portions 115 is in the form of a vertical duct that includes an upper duct portion 116 extending downward from the rear end portion 104*a* of the placement section 104, and a lower duct portion 117 extending downward from a lower end portion 116*a* of the upper duct portion 116.

Each of the upper duct portions 116 has a downward slope portion 121 extending downward from a side surface of the middle partitioning section 106 to a guide rib 122 projecting vertically upward from the upper duct portion 116. Thus, air having been guided downward to the upper duct portion 116 is guided laterally by the downward slope portion 121 to the guide rib 122 as indicated by an arrow in FIG. 13.

The guide rib 122 is provided vertically near a side end of the upper duct portion 116 and also bulges rearwardly of the upper duct portion 116. The guide rib 122 is a rib for further guiding the air, having been guided downward to the upper duct portion 116, toward a corresponding separating rib 123 as indicated by an arrow in FIG. 14.

Further, as shown in FIGS. 2 and 14, the separating rib 123 is provided on a portion 24*d* of the engine cover's rear wall 24*c* that is opposed to the corresponding upper duct portion 116. More specifically, the separating rib 123 is located laterally outwardly of the corresponding guide rib 122. The separating rib 123 is provided vertically in generally parallel to the guide rib 122.

The separating ribs 123, provided near the outer ends of the upper vertical duct portions 116, can impede flows of the air laterally guided by the upper vertical duct portions 116, and thus, water contained in the air can be separated from the air by contacting the separating ribs 123.

Further, the water separated by the separating ribs 123 can be dripped down along the ribs 123. In this way, the instant embodiment of the outboard engine unit 10 can reliably separate the water, contained in the air, from the air by means of the separating ribs 123.

In addition, the instant embodiment includes, as the air intake passageway 73, the two air intake passageway sections 73A and 73B having their respective divided duct portions 115, as shown in FIGS. 8 and 9. Further, the separating ribs 123 are provided on portions of the engine cover 24 that are opposed to corresponding ones of the divided duct portions 115. Such separating ribs 123 can impede flows of air having been guided to the corresponding air intake passageway sections 73A and 73B and separate, from the air, water having flown into the corresponding air intake passageway sections 73A and 73B. In this way, the instant embodiment can reliably separate the water, having been sucked in together with the air, from the air by means of the separating ribs 123.

As shown in FIG. 14, the guide ribs 122 are provided upstream of the corresponding separating ribs 123. Thus, air having been directed to the upper vertical duct portions 116 can be efficiently guided to the separating ribs 123 by means of the guide ribs 122, so that water having been directed together with the air can be efficiently caused to contact the separating ribs 123. In this way, the instant embodiment of the outboard engine unit 10 can reliably separate the water, having been sucked in together with the air, from the air by means of the separating ribs 123. The separating ribs 123 and the guide ribs 122 are shaped such that intake resistance of the air would not increase due to the provision of the guide ribs 122 and separating ribs 123.

Further, as shown in FIGS. 13 and 15, each of the lower duct portions 117 includes a middle bulge portion 126 bulging rearward from a widthwise middle region thereof, an upward slope 128 provided laterally outwardly of the middle bulge portion 126 and sloping upward from a bottom portion 127, and a drain outlet port 129 provided in an outer end region of the bottom portion 127 underneath the upward slope 128.

The bottom portions 127 extend in a downward slope of an inclination angle θ3 from the middle partitioning section 106 toward their respective outer ends. The drain outlet ports 129 are provided near the outer ends, and hence the lowest positions, of the bottom portions 127.

The water, having been separated from the air by means of the separating ribs 123, drips down onto the bottom portions 127. The water, having dripped down onto the bottom portions 127, is then guided along the bottom portions 127 to the drain outlet ports 129 and discharged out of the lower duct portions 117 through the drain outlet ports 129.

When the downward air, having been guided to the upper vertical duct portions 116, is diverted laterally by the downward slope portions 121 as indicated by arrows B1 in FIG. 13, a part of the air would be directed downward to the lower duct portions 117 as indicated by an arrow B2 in FIG. 13. The air thus directed downward then flows upward along the upward slopes 128 as indicated by an arrow B3 in FIG. 13.

Further, each of the side guide sections 107 has a side partitioning wall 119 that extends forward from an outer lower end portion 116*b* of the corresponding upper vertical duct portion 116 to an outer side portion 77*a* of the silencer 77 and protrudes upward from a front end portion 107*b* of the side guide section 107. One of the side guide sections 107 constitutes a part of the air intake passageway section 73A, while the other side guide section 107 constitutes a part of the air intake passageway section 73B. Because the side guide sections 107 are identical in construction, the following mainly describe the one side guide section 107.

The side guide section 107 communicates at its rear end portion 107*a* with the corresponding downward slope portion 121 and communicates at its front end portion 107*b* with a corresponding one of inlet ports 136 of the silencer 77.

The side partitioning wall 119 is spaced by a predetermined interval from the rear partitioning wall 113. The respective upper ends of the partitioning wall 119 and rear partitioning wall 113 abut against the underside of the guide bottom section 81 (see FIG. 4). In this manner, the inlet port 136 of the silencer 77 is formed between the side partitioning wall 119 and the rear partitioning wall 113.

Because the side guide section 107 communicates at the front end portion 107*b* with the inlet port 136, air from which water has been separated by the separating rib 123 is directed to the side guide section 107 as indicated by arrow B4. The air having been directed to the side guide section 107 is directed from the side guide section 107 into a silencer chamber 135 through the inlet port 136.

Meanwhile, the air having been directed downward to the lower duct portion 117 flows upward along the upward slope 128 as indicated by arrow B3 and is then directed to the side guide sections 107 as indicated by arrow B4. The air having been directed to the side guide section 107 is then directed into the silencer chamber 135 through the inlet port 136 as indicated by arrow.

The divided duct portion 115 constitutes the interference-type muffler section 75A in conjunction with the rear wall 24*c* of the engine cover 24. The interference-type muffler section 75A functions to reduce air suction noise transmitted via the inlet port 136 to the silencer 77. Details of the interference-type muffler section 75A will be discussed later.

As shown in FIG. 4, the silencer 77 includes a silencer body section 132 composed of a rear portion 55*b* of the belt cover 55 and a rear portion of the fan cover 56 (i.e., rear portion 57*c* of the first fan cover member 57 and a rear portion 58*b* of the second fan cover member 58), a cover section 133 provided over the silencer body section 132, and the silencer chamber 135. Namely, the silencer body section 132 is provided on the belt cover 55 and fan cover 56. The silencer body section 132 also includes a lower half section 135*a* of the silencer chamber 135 (i.e., lower-half silencer chamber section 135*a*) (see also FIG. 4).

Further, in the silencer body section 132, the lower-half silencer chamber section 135*a* has openings 138 (FIG. 13) formed in opposite side portions of the rear portion 58*b* of the second fan cover member 58, and an outlet port 139 (FIG. 18) formed in a rear end portion thereof. The outlet port 139 is defined with the rear portion 55*b* of the belt cover 55 and the rear portion 58*b* of the second fan cover member 58, and it is in communication with the throttle body 42 via a communication passageway 141.

The cover section 133, provided over the silencer body section 132, is composed of the second fan cover member 58, guide bottom section 81, front partitioning wall 144, rear partitioning wall 113 and seal member 143.

As shown in FIGS. 12 and 14, the seal member 143 has a generally pentagonal frame shape as viewed in plan and fixedly mounted on the upper surface of the rear portion 58*b* of the second fan cover member 58. As shown in FIG. 4, the seal member 143 has a front half portion 143*a* pressed from above by the lower end of the front partitioning wall 144 that is in the form of a projection projecting downward from the underside of the guide bottom section 81. Further, the seal member 143 has a rear half portion 143*b* pressed from above by the lower end of the rear partitioning wall 113 that is abutted against the underside of the guide bottom section 81.

With the front half portion 143*a* of the seal member 143 pressed by the front partitioning wall 144 and the rear half portion 143*b* pressed by the rear partitioning wall 113 as noted above, the cover section 133 of the silencer 77 is composed of the second fan cover member 58, guide bottom section 81, front partitioning wall 144 and rear partitioning wall 113.

Figure 17:
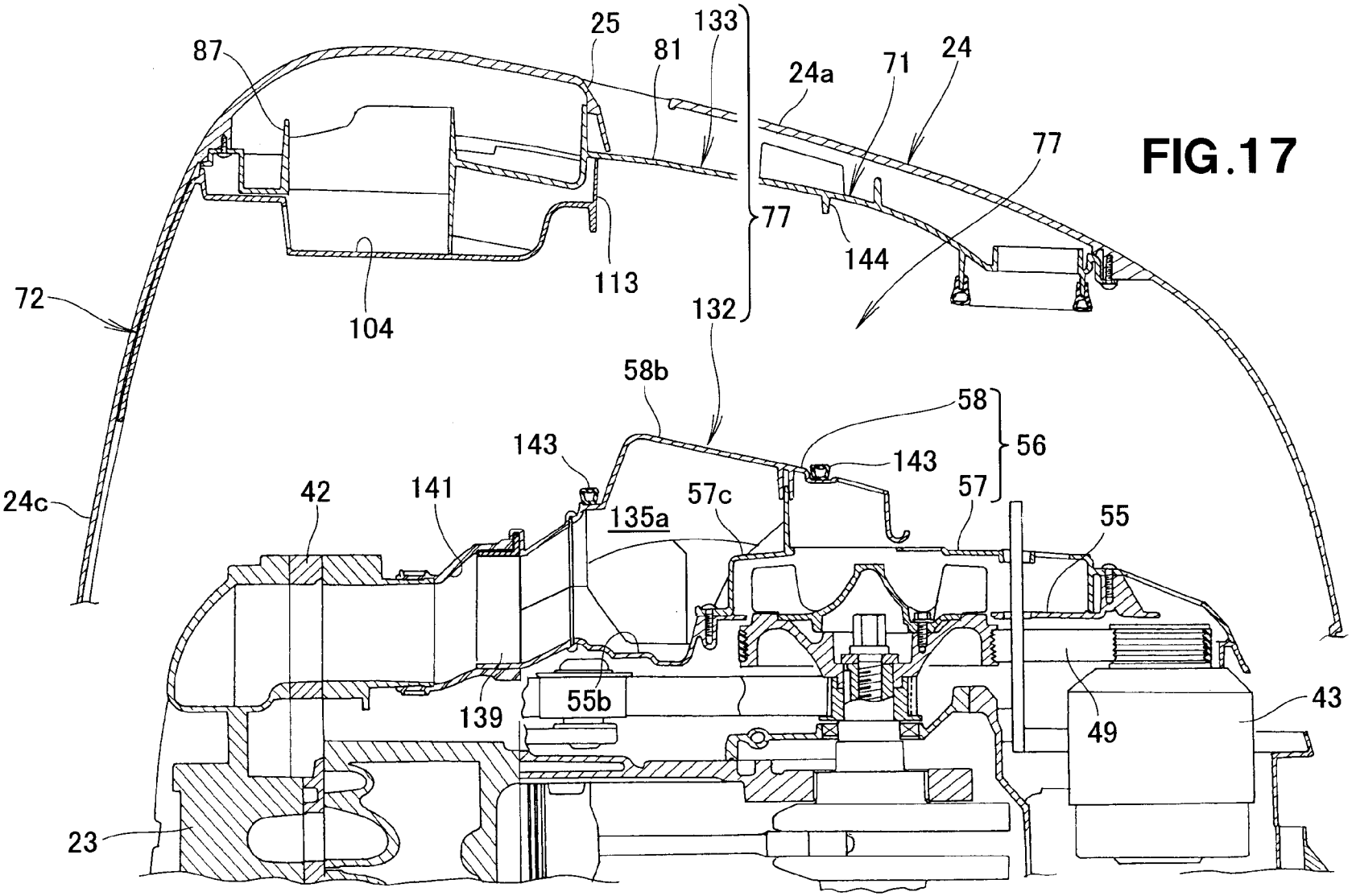
FIG. 17 is an exploded sectional view of a silencer of FIG. 3.

As seen in FIG. 17, the guide bottom section 81 (i.e., air guide 71) is provided on the engine cover 24. Thus, the cover section 133 is detachably attached to the silencer body section 132 from above. The cover section 133 includes an upper half section 135*b* of the silencer chamber 135 (i.e., upper-half silencer chamber section 135*b*) (see FIG. 4). The upper-half silencer chamber section 135*b* and the lower-half silencer chamber section 135*a* are in communication with each other via the openings 138 formed in the opposite side portions of the rear portion 58*b* of the second fan cover member 58 (see FIG. 14).

The silencer 77 has the inlet ports 136 communicating with the corresponding side guide sections 107 as shown in FIG. 14 and has the outlet port 139 communicating with the throttle body 42 via the communication passageway 141. Thus, as indicated by arrows in FIG. 14, air directed via the side guide sections 107 to the inlet ports 136 is then directed from the inlet ports 136 to the upper-half silencer chamber section 135*b* and then to the lower-half silencer chamber section 135*a* through the openings 138 (see also FIG. 4).

Figure 18:
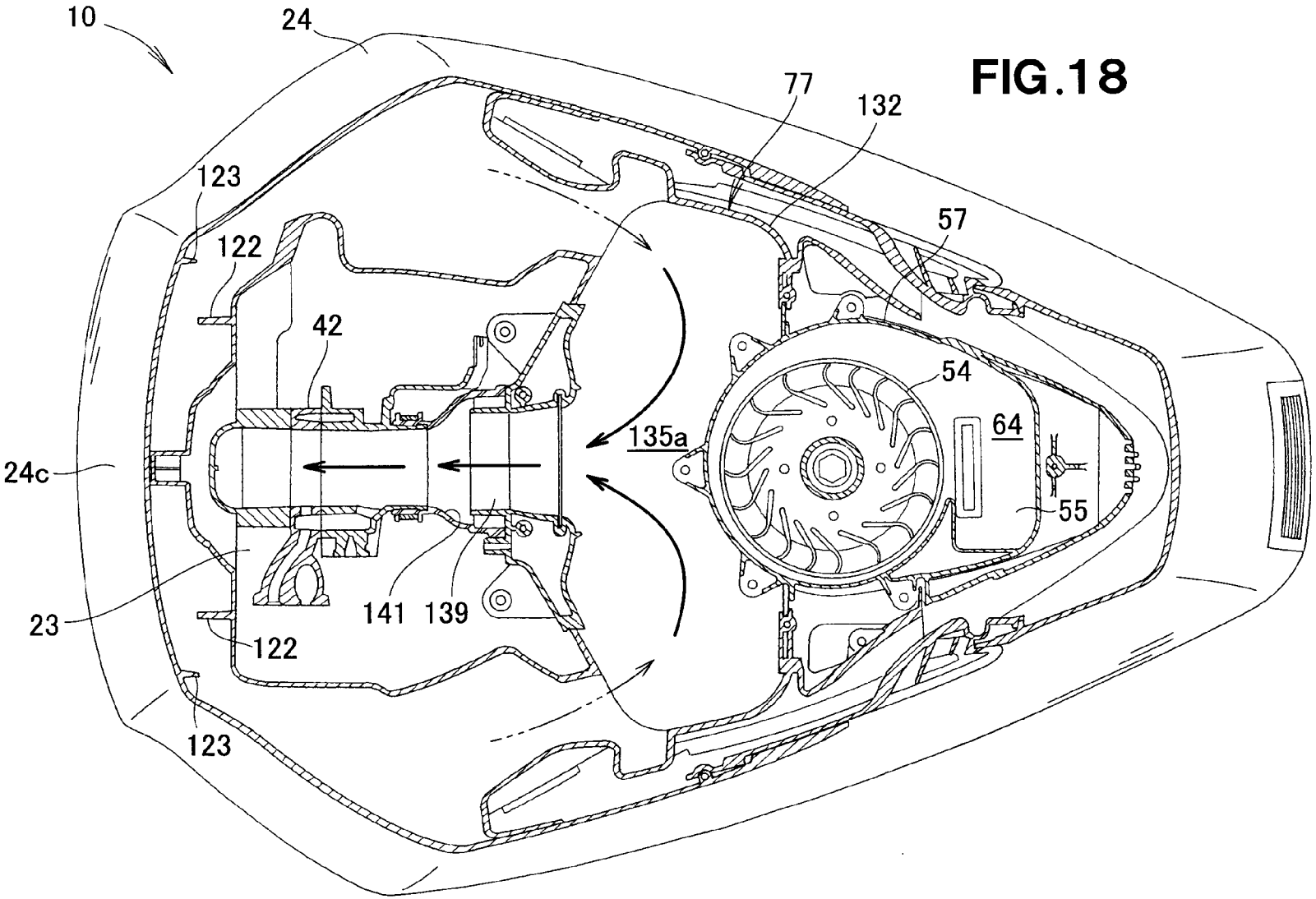
FIG. 18 is a sectional view taken along line 18-18 of FIG. 1.

The air having been directed to the lower-half silencer chamber section 135*a* is directed to the throttle body 42, which is in communication with the combustion chamber of the engine 23, via the outlet port 139 and communication passageway 141, as indicated by arrows in FIG. 18. The silencer 77 functions to reduce air suction noise produced due to intake air pulsation and impact wave during running of the engine 23.

As shown in FIG. 4, the silencer body section 132 is provided on the belt cover 55 and fan cover 56, and the cover section 133 is provided on the engine cover 24. The following explain the reason why the silencer body section 132 is provided on the belt cover 55 etc. and the cover section 133 is provided on the engine cover 24.

Namely, in the conventionally-known outboard engine units, the silencer is between the engine cover and the belt cover, in which case the silencer may undesirably interfere with the engine cover and the belt cover. In order to prevent such interference by the silencer, there is a need to provide interference-preventing spaces between the engine cover and the silencer and between the belt cover and the silencer.

By contrast, in the instant embodiment of the outboard engine unit 10, the silencer body section 132 is provided on the belt cover 55 and fan cover 56, and the cover section 133 of the silencer 77 is provided on the engine cover 24. Thus, the instant embodiment can eliminate the need to provide interference-preventing spaces between the engine cover 24 and the silencer 77 and between the belt cover 55 (including the fan cover 56) and the silencer 77, and can use such spaces as a capacity-increasing space for the silencer 77. Thus, the instant embodiment can increase the capacity of the silencer 77 without increasing the size of the engine cover 24, thereby sufficiently reducing air suction noise produced in the air intake passageway 73 (intake air pulsation and impact wave).

Further, the cover section 133 is detachably attached to the silencer body section 132 from above, as noted previously. Thus, the silencer chamber 135 can be opened merely by the cover section 133 being detached from the silencer body section 132. In this way, grit and dust can be readily removed without trouble.

Furthermore, with the seal member 143 provided between the silencer body section 132 and the cover section 133, the instant embodiment can sufficiently reduce air suction noise in the air intake passageway 73 by securing reliable sealing performance between the silencer body section 132 and the cover section 133.

Now, a detailed description will be given about the drain/interference-type muffler 75, with reference to FIGS. 13 and 16. As shown in FIGS. 13 and 16, the drain/interference-type muffler 75 is provided vertically within the engine cover 24, and the middle partitioning section 106 extends vertically to horizontally divide the interference-type muffler 75 into the pair of interference-type muffler sections 75A and 75B.

One of the interference-type muffler sections 75A is composed of one of the divided duct portions 115 and a portion of the engine cover's rear wall 24*c* that is opposed to the one interference-type muffler section 75A. The one interference-type muffler section 75A is provided at an en route position of one of the air intake passageway sections 73A (see FIG. 9) and in communication with the throttle body 42 via the silencer 77.

The other interference-type muffler section 75B is composed of the other divided duct portions 115 and a portion of the engine cover's rear wall 24*c* that is opposed to the other interference-type muffler section 75B. The other interference-type muffler section 75B is provided at an en route position of the other air intake passageway section 73B (see FIG. 9) and in communication with the throttle body 42 via the silencer 77. The throttle body 42 is in communication with the combustion chamber of the engine 23.

When air suction noise has been produced due to intake air pulsation and impact wave during running of the engine 23, the produced air suction noise is directed to the side guide sections 107 via the inlet ports 136 of the silencer 77 as indicated by a thin-line arrow in FIG. 13. The air suction noise, having been directed to the side guide sections 107, is directed from side guide sections 107 to the upper duct portions 116 as indicated by a thin-line arrow in FIG. 13 and then to the lower duct portions 117 as indicated by a thin-line arrow in FIG. 13.

Then, the air suction noise, having been directed to the lower duct portions 117, is transmitted downward in and along the lower duct portions 117 to the upward slopes 128 as indicated by a thin-line arrow in FIG. 13. After that, the air suction noise is diverted upward via the upward slopes 128 and middle bulge portions 126 as indicated by a thin-line arrow in FIG. 13.

The air suction noise, having been directed upward from the lower duct portions 117, interferes, at interference positions P1 (only one of which is shown in FIG. 13), with the air suction noise having been directed from the side guide sections 107 to the upper duct portions 116. At the interference positions P1, the air suction noise having been directed upward from the lower duct portions 117 to the upper duct portions 116 (i.e., second air suction noise) is inverted in phase of frequency relative to the air suction noise having been directly directed from the side guide sections 107 to the upper duct portions 116 (i.e., first air suction noise).

Namely, the interference-type muffler sections 75A and 75B are constructed in such a manner that the second air suction noise is inverted in phase of frequency relative to the first air suction noise at interference positions P1 through adjustment of areas and lengths of passageways of the first air suction noise and second air suction noise. By thus causing the phase-inverted second air suction noise to interfere with the first air suction noise at the interference positions P1, the interference-type muffler 75 can reduce the air suction noise transmitted through the outlet ports 136 of the silencer 77.

In the aforementioned manner, the drain/interference-type muffler 75 can attenuate frequency bands of air suction noise, included in exhaust sound, that produces a particular great sound pressure. Thus, the interference-type muffler 75 in the instant embodiment can sufficiently reduce air suction noise produced due to intake air pulsation and impact wave during operation or running of the engine 23.

As in the outboard engine units, there exists a dead space between the engine cover (particularly the engine cover's rear wall 24*c*) and the engine 23. Thus, in the instant embodiment, the drain/interference-type muffler 75 is provided vertically in such a dead space, to make efficient use of the dead space. Such an arrangement can eliminate a need to secure a particular separate space for providing therein the drain/interference-type muffler 75, so that the outboard engine unit 10 can be significantly reduced in size.

Furthermore, because the drain outlet ports 129 are provided in the bottom portion 127 of the vertically-provided drain/interference-type muffler 75, water separated from air by the drain/interference-type muffler 75 can be dripped down onto the bottom portion 127, and the thus-dripped-down can be discharged out of the drain/interference-type muffler 75 through the drain outlet ports 129. In the aforementioned manner, the drain/interference-type muffler 75 can separate water from air and guide the air, having the water separated therefrom, to the throttle body 42 (see FIG. 18).

Namely, the drain/interference-type muffler 75 has both a muffling function for reducing air suction noise and a water separation function for separating water from air. Thus, there is no need to separately provide a member having the muffling function and a member having the water separation function, so that the outboard engine unit 10 can be even further reduced in size and reduced in the number of necessary component parts.

Figure 19:
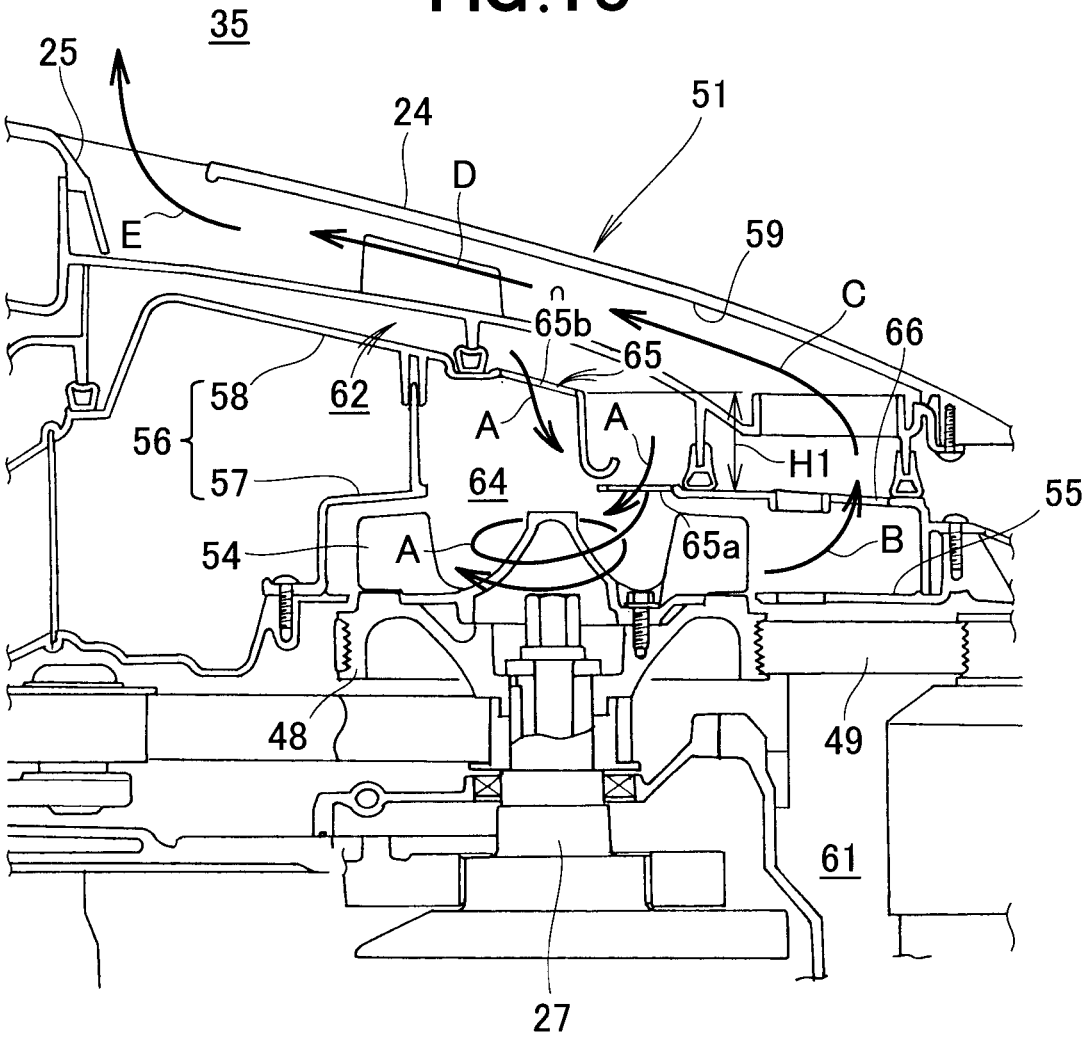
FIG. 19 is a view illustrating a manner in which air within the engine cover is discharged to outside through the exhaust section in the embodiment of the present invention.

The following describe, with reference to FIG. 19, a manner in which air within the engine cover 24 is discharged to the outside 35 by means of the exhaust section (ventilation section) 51. As shown in FIG. 19, the height difference H1 is provided between the first fan cover member 57 and the second fan cover member 58, and the first intake port 65*a* is formed in the first fan cover member 57 while the second intake port 65*b* is formed in the second fan cover member 58.

By rotation of the exhaust fan 54, air within the air intake/exhaust chamber 62 is directed into the exhaust fan chamber 64 as air flows of a scroll or spiral shape as indicated by arrow A, so that the air can be efficiently and smoothly sucked from the air intake/exhaust chamber 62 into the exhaust fan chamber 64.

Then, the air, having been sucked into the exhaust fan chamber 64, is directed to outside of the exhaust fan chamber 64 (i.e., to the exhaust passageway 59) through the exhaust outlet port 66 as indicated by arrow B. The air, having been directed to the exhaust passageway 59 is guided along the exhaust passageway 59 as indicated by arrow D and then discharged to the outside 35 of the engine cover 24 through the exhaust opening 25 as indicated by arrow E.

Because the air intake/exhaust chamber 62 is in communication with the engine room 61 as noted previously, air within the air intake/exhaust chamber 62 and within the engine room 61 can be reliably discharged to the outside 35 of the engine room 24. Thus, the air within the air intake/exhaust chamber 62 and within the engine room 61 can be maintained at appropriate temperature.

Figure 22A:
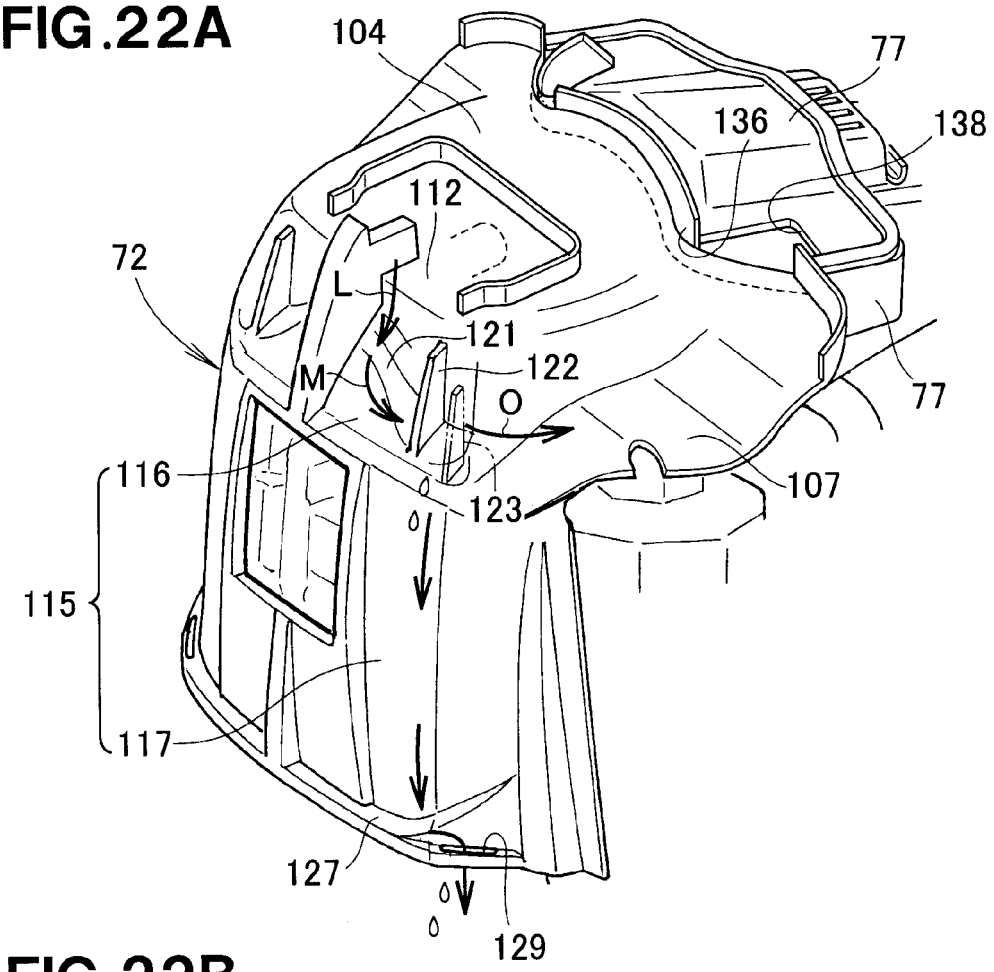
FIGS. 22A and 22B are views illustrating a manner in which water is separated from air by means of a separating rib of a drain/interference-type muffler in the embodiment of the present invention.
Figure 22B:
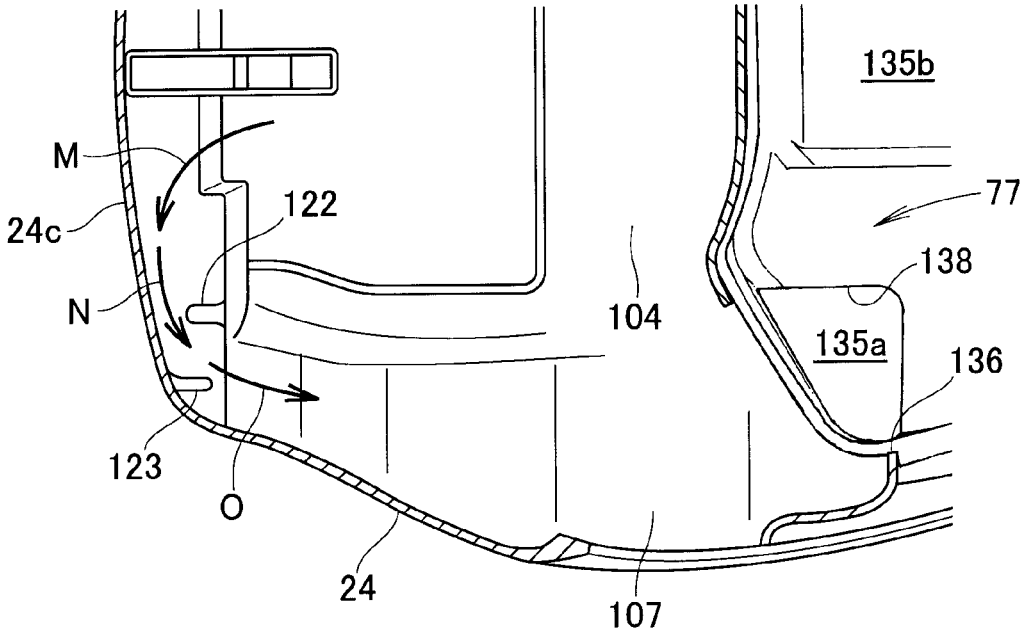
Figure 23A:
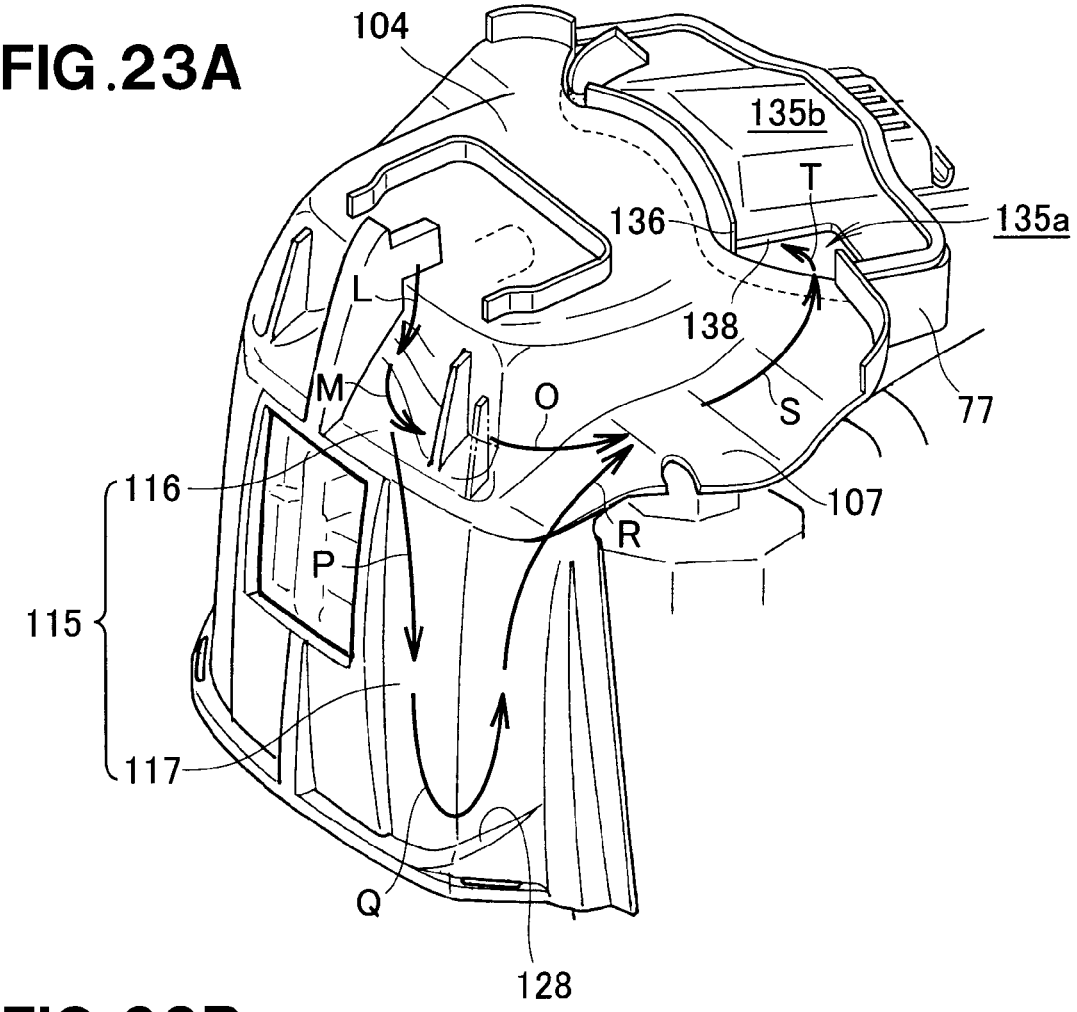
FIGS. 23A and 23B are views illustrating a manner in which air is directed to a throttle body in the embodiment of the present invention.
Figure 23B:
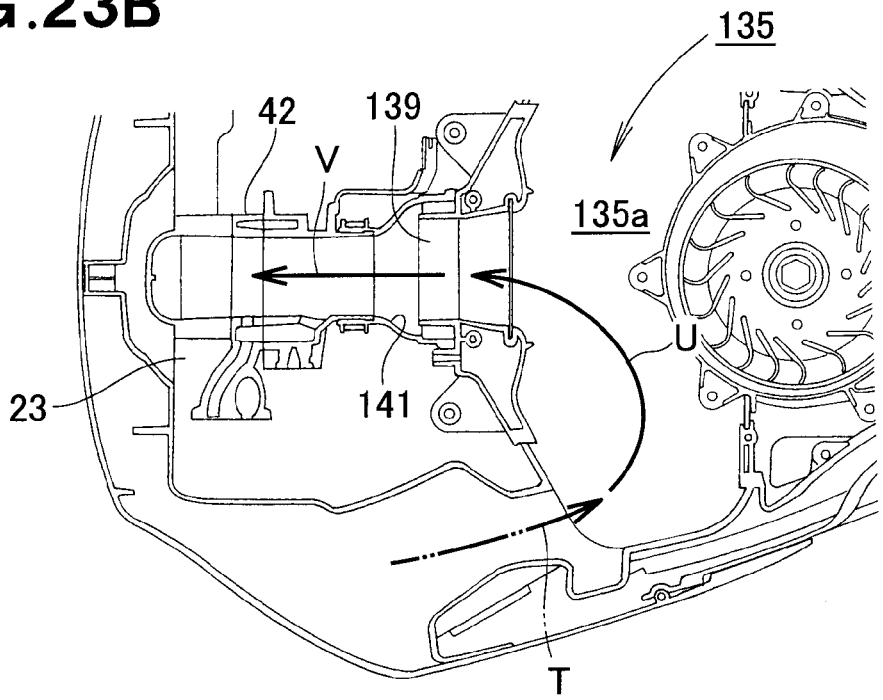

The following paragraphs describe, with reference to FIGS. 20 to 23, a manner in which air sucked in from the outside 35 of the engine cover 24 is directed to the throttle body 42 (see FIG. 23B). To facilitate understanding, flows of air only in one of the air intake passageway sections 73A (see FIG. 9) are shown and described in FIGS. 20 to 23.

Figure 20A:
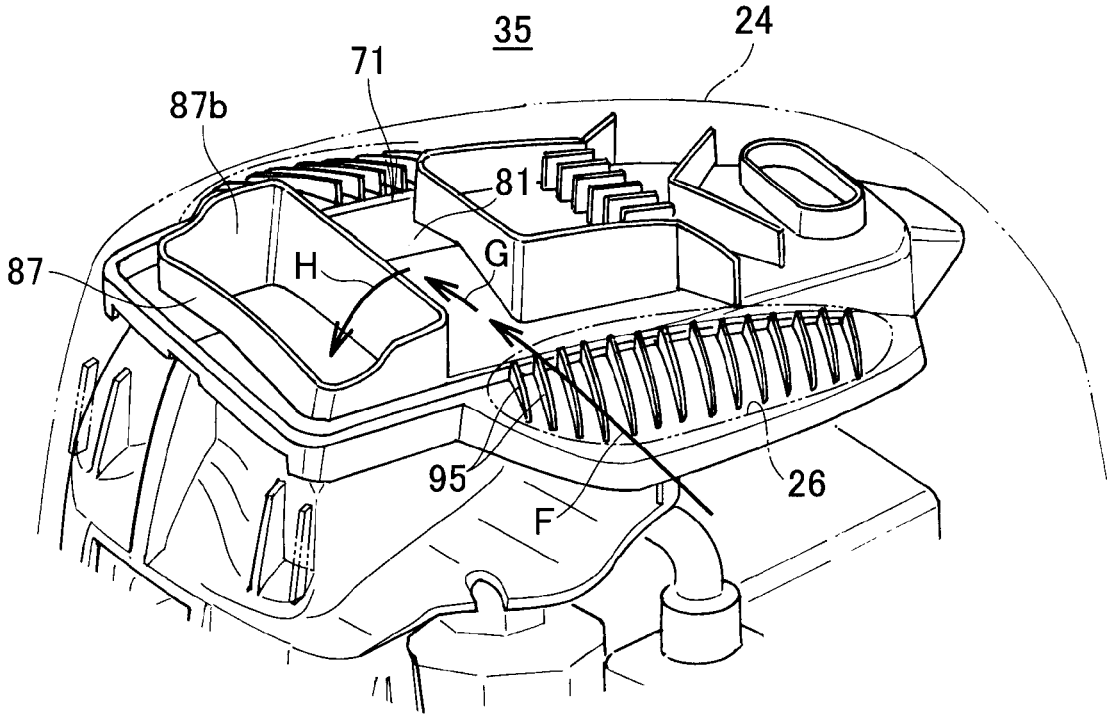
FIGS. 20A and 20B are views illustrating a manner in which water is discharged to outside through a drain groove in the embodiment of the present invention.
Figure 20B:
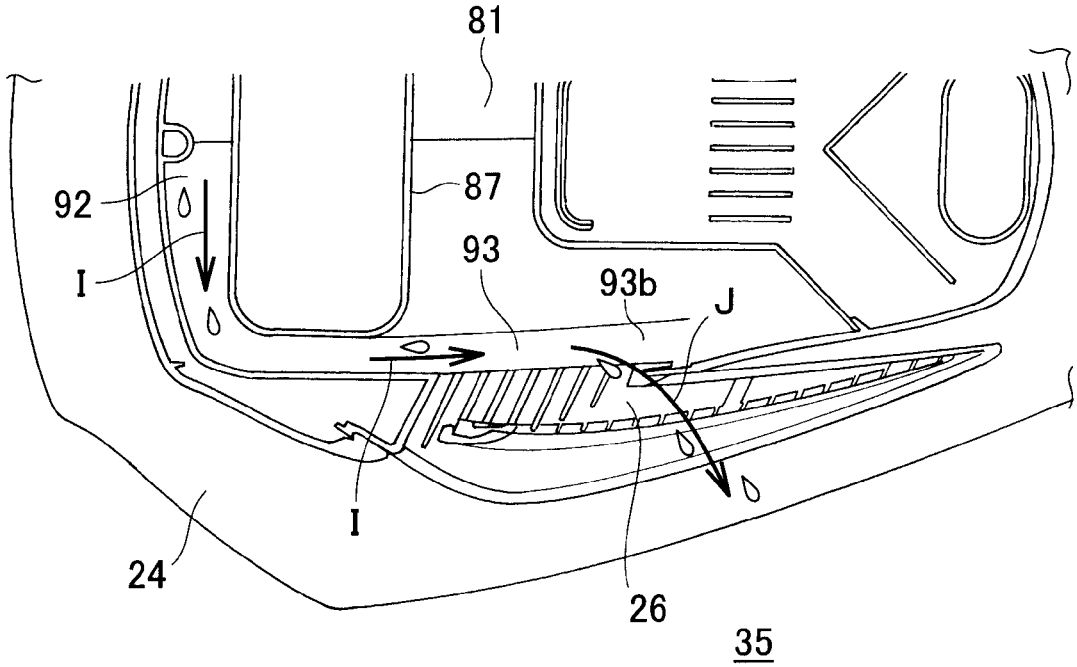
Figure 21:
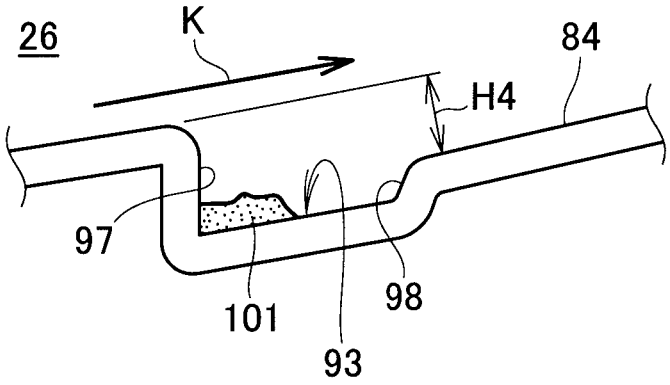
FIG. 21 is a view illustrating a manner in which water directed to the drain groove of FIG. 20 is prevented from being kicked up.

First, the following describe, with reference to FIGS. 20 and 21, a manner in which water is separated from air directed to the air guide 71 through the air intake opening 26 of the engine cover 24. As shown in FIG. 21A, air is directed toward the air guide 71 through the air intake opening 26 of the engine cover 24 as indicated by arrow F.

More specifically, the air, having been sucked in through the air intake opening 26, is directed into the engine cover 24 via the plurality of guide plates 95, during which time water contained in the air is separated from the air by contacting the guide plates 95.

The air having the water separated therefrom by means of the guide plates 95 is directed, along the guide bottom section 81 of the air guide 71, to the air intake guide section 87. Thus, the flowing direction of the air sucked in through the air intake opening 26 is changed to upward by the air intake guide section 87 as indicated by arrow G in FIG. 20A, so that water contained in the air is separated from the air by contacting the outer peripheral surface of the air intake guide section 87.

The air having the water separated therefrom by means of the air intake guide section 87 is sucked into the air intake guide section 87 through the air intake port 87*b* and then directed vertically downward as indicated by arrow H in FIG. 20A.

As shown in FIG. 20B, the water, having been separated from the air by means of the air intake guide section 87, drips down along the outer peripheral surface of the air intake guide section 87 and is then directed to the rear drain groove section 92 and side drain groove section 93, after which is guided along the side drain groove section 93 to the front end portion 93*b* as indicated by arrow I in FIG. 20B. The water having been guided to the front end portion 93*b* is then discharged to the outside 35 of the engine cover 24 through the side air intake opening 26 as indicated by arrow J in FIG. 20B.

In the side drain groove section 93, as shown in FIG. 21, the outer groove wall 97 is formed to be located higher than the inner groove wall 98 by the height dimension H4. Air sucked through the air intake opening 26 toward the air intake guide section 87 flows over the side drain groove section 93, intersecting the side drain groove section 93, as indicated by arrow K.

Thus, with the outer groove wall 97 formed to be located higher than the inner groove wall 98 by the height dimension H4, the water 101 present in the side drain groove 93 can be greatly separated from the air flowing over the side drain groove section 93, and thus, the water can be prevented from being undesirably kicked up by the air, flowing over the side drain groove section 93, to outside of the side drain groove section 93. In this way, the instant embodiment of the outboard engine unit 10 can efficiently guide the water, present in the side drain groove section 93, to the front end portion 93*b* and then reliably discharge the water to the outside 35 of the engine cover 24 through the air intake opening 26, as seen in FIG. 20B.

The following describe, with reference to FIGS. 22 and 23, a manner in which water is separated from air having been directed to the divided duct portion 115 of the drain/interference-type muffler 75. Air directed to the air intake guide section 87 (see FIG. 20A) is directed downward, via the guide opening portion 112, along the upper duct portion 116 of the vertical duct section 105, as indicated by arrow L in FIG. 22A. Then, the air, having been directed downward along the upper duct portion 116, is guided laterally to the guide rib 122 as indicated by arrow M.

The air, having been laterally to the guide rib 122 is then guided to the separating rib 123 as indicated by arrow N in FIG. 22B, so that flows of the air can be impeded by the separating rib 123, during which time water in the air can be separated from the air by contacting the separating rib 123. The air having the water thus separated therefrom is guided to the side guide section 107 as indicated by arrow O in FIG. 22A.

Meanwhile, the water, having been separated from the air by means of the separating rib 123, is dripped down onto the bottom portion 127 as indicated by an arrow in FIG. 22A and then guided to outside of the lower duct portion 117 through the drain outlet port 129.

A portion of the air guided downward to the upper duct portion 116 is further directed downward to the lower duct portion 117 as indicated by arrow P in FIG. 23A, then directed upward along the upward slope 128 as indicated by arrow Q in FIG. 23A, and then directed to the side guide section 107 as indicated by arrow R in FIG. 23A.

The air directed to the side guide section 107 as indicated by arrow O and the air directed to the side guide section 107 as indicated by arrow R is then directed from the side guide section 107 to the upper-half silencer chamber section upper half section 135*b* through the inlet port 136 as indicated by arrow S in FIG. 23A, and then directed to the lower-half silencer chamber section 135*a* through the opening 138 of the silencer 77 as indicated by arrow T.

Then, the air having been directed to the lower-half silencer chamber section 135*a* is directed to the outlet port 139 of the silencer chamber 135 as indicated by arrow U in FIG. 23B and then to the throttle body 42 via the communication passageway 141 as indicated by arrow V in FIG. 23B.

As set forth above in relation to FIGS. 20 to 23, water can be sufficiently separated from air by the plurality of guide plates 95, air intake guide section 87 and separating rib 123 provided in the interference-type muffler section 75A. In this way, air from which water has been sufficiently separated (i.e., which contains no water) can be supplied to the throttle body 42.

The following describe, with reference to FIG. 24, a manner in which air suction noise produced due to intake air pulsation and impact wave during running of the engine 23 is reduced by means of the silencer 77 and drain/interference-type muffler 75. To facilitate understanding, a description will be given only in relation to one of the air intake passageway sections 73A (see FIG. 9).

Figure 24A:
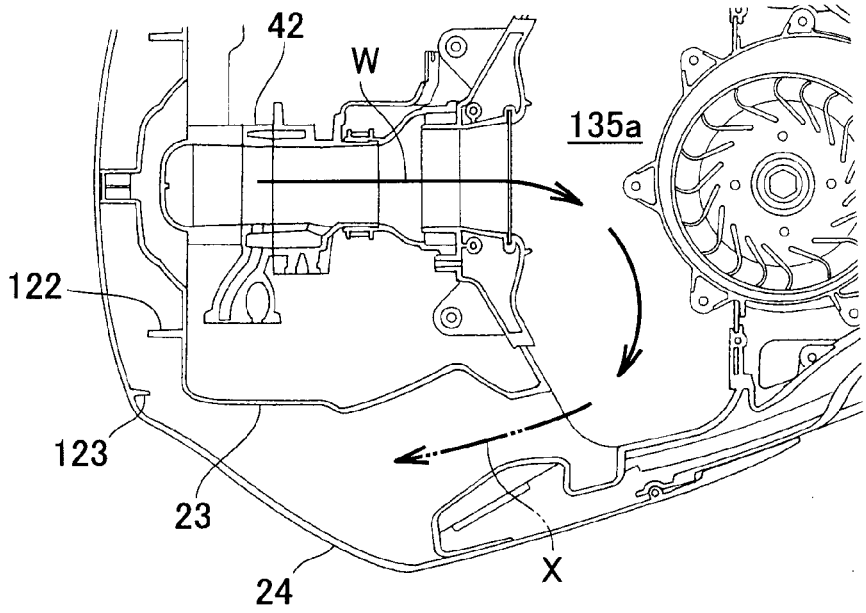
FIGS. 24A and 24B are views illustrating a manner in which air suction noise is reduced by means of the silencer and drain/interference-type muffler in the embodiment of the present invention.

Air suction noise is produced due to intake air pulsation and impact wave during running of the engine 23, as shown in FIG. 24A. The thus-produced air suction noise is transmitted via the throttle body 42 to the lower-half silencer chamber section 135*a* as indicated by arrow W in FIG. 24A.

Figure 24B:
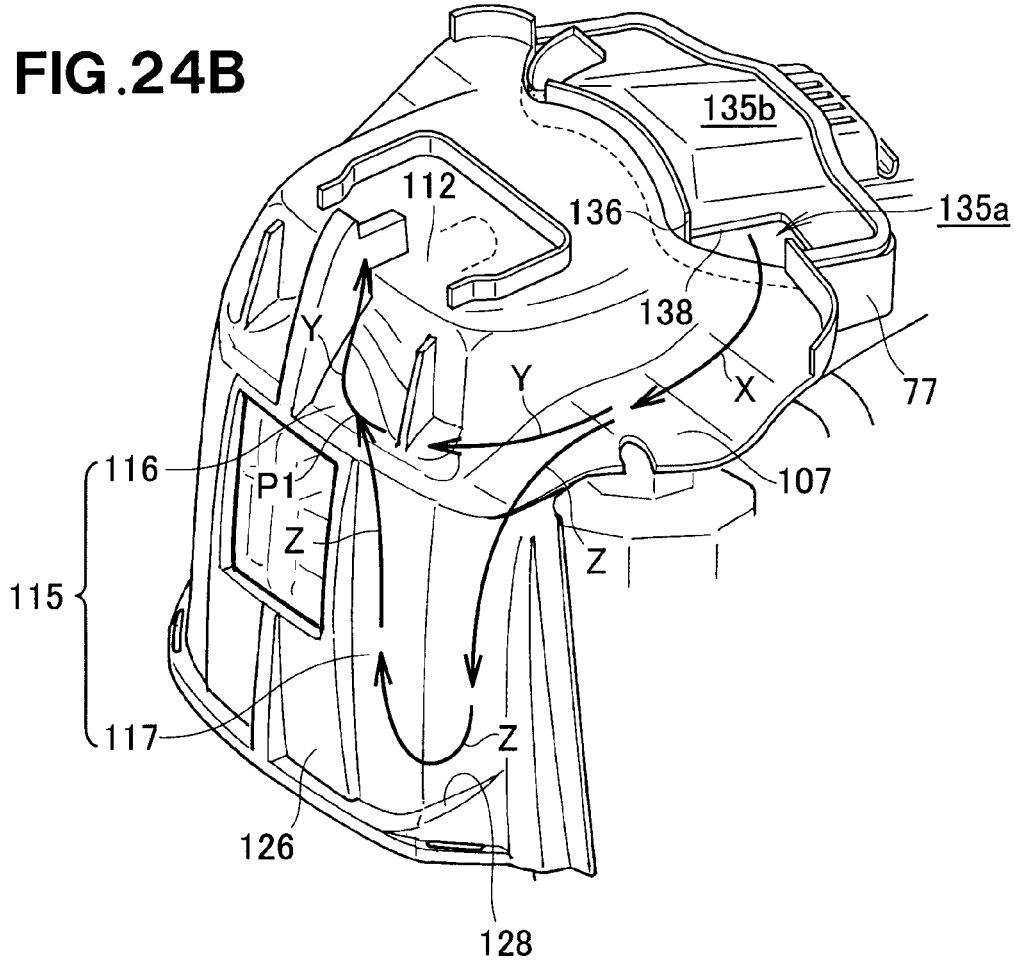

As shown in FIG. 24B, the lower-half silencer chamber section 135*a* is in communication with the upper-half silencer chamber section 135*b* via the opening 138, so that the produced air suction noise is attenuated by the silencer 77 (silencer chamber 135 of FIG. 4). The thus-attenuated air suction noise is transmitted through the inlet port 136 of the silencer 77 to the side guide section 107 as indicated by arrow X in FIG. 24A, after which it is transmitted from the side guide section 107 to the interference-type muffler section 75A.

More specifically, the air suction noise transmitted to the side guide section 107 is then transmitted from the side guide section 107 to the upper duct portion 116 as indicated by arrow Y in FIG. 24B and to the lower duct portion 117 as indicated by arrow Z in FIG. 24B. The air suction noise transmitted to the upper duct portion 116 is then transmitted from the upper duct portion 116 to the guide opening portion 112 as indicated by arrow Y in FIG. 24B.

Meanwhile, the air suction noise transmitted to the lower duct portion 117 is transmitted in and along the lower duct portion 117 downward to the upward slope 128 as indicated by arrow Z, by which a flowing direction of the air suction noise is changed to an upward direction, i.e. diverted upward, via the upward slope 128 and middle bulge portion 126. The thus-upwardly-diverted air suction noise (i.e., second air suction noise) interferes, at the interference position P1, with the air suction noise directed from the side guide section 107 to the upper duct portion 116 as indicated by arrow Y (i.e., first air suction noise).

At the interference position P1, the air suction noise having been transmitted from the lower duct portion 117 to the upper duct portion 116 as indicated by arrow Z in FIG. 24B (i.e., second air suction noise) is inverted in phase of frequency relative to the air suction noise having been transmitted from the side guide sections 107 to the upper duct portions 116 (i.e., first air suction noise). Because the phase-inverted second air suction noise interferes with the first air suction noise at the interference position P1, the instant embodiment of the outboard engine unit 10 can effectively reduce the air suction noise transmitted via the inlet port 136 of the silencer 77.

Because the air intake passageway section 73A includes the silencer 77 and the drain/interference-type muffler section 75A, the air suction noise can be sufficiently reduced by both of the silencer 77 and the drain/interference-type muffler section 75A.

Needless to say, the foregoing description also applies to the other air intake passageway section 73B.

It should be appreciated that the outboard engine unit of the present invention is not limited to the above-described embodiment and may be modified variously as appropriate. For example, the outboard engine unit 10, engine 23, engine cover 24, exhaust opening 25, engine accessories 41, drive belt 49, exhaust fan 54, belt cover 55, fan cover 56, exhaust passageway 59, exhaust fan chamber 64, etc. are not limited to the shapes and constructions shown and described above and may be modified as appropriate.

The basic principles of the present invention are well suited for application to outboard engine units which include an engine provided within an engine cover and which is constructed to discharge air within the engine cover to outside of the engine cover.

What is claimed is:

1. An outboard engine unit comprising:

an engine cover covering an engine, a drive belt for driving engine accessories being provided within the engine cover;

a belt cover covering an upper portion of the drive belt; and an exhaust fan chamber defined with the belt cover and a fan cover provided over the belt cover, the exhaust fan chamber being partitioned off from an interior of the engine cover, an exhaust fan being accommodated in the exhaust fan chamber, wherein the fan cover has an air intake port for sucking air within the engine cover into the exhaust fan chamber and an exhaust outlet port for discharging air within the exhaust fan chamber to outside of the exhaust fan chamber, wherein the exhaust outlet port is in communication with an exhaust opening formed in an upper portion of the engine cover so that the air discharged out of the exhaust fan chamber through the exhaust outlet port is discharged to outside of the engine cover through the exhaust opening, wherein the fan cover has a height difference such that the exhaust fan chamber has a generally scroll-shape, wherein the fan cover comprises a first fan cover member provided over the belt cover, and a second fan cover member provided over a rear part of the first fan cover member and disposed higher than the first fan cover member so that the height difference is provided between the first and second fan cover members, and wherein the air intake port includes a first air intake port formed in the first fan cover member, and a second air intake port formed in the second fan cover member so that the height difference is provided between the first and second air intake ports, the first and second air intake ports disposed over the exhaust fan so that rotation of the exhaust fan causes the air within the engine cover to be sucked into the generally scroll-shaped exhaust fan chamber via the first and second air intake ports as air-flows of a spiral shape.

2. The outboard engine unit according to claim 1, wherein the exhaust outlet port and the exhaust opening are in communication with each other via an exhaust passageway provided in an upper portion of the engine cover.

3. The outboard engine unit according to claim 1, wherein the exhaust outlet port comprises a plurality of exhaust outlet ports formed in a front part of the first fan cover member, the first air intake port comprises a plurality of first air intake ports formed in a substantially middle part of the first fan cover member, and the second air intake port comprises a plurality of second air intake ports formed in a front part of the second fan cover member.

* * * * *